US007412936B2

(12) United States Patent
Price et al.

(10) Patent No.: US 7,412,936 B2
(45) Date of Patent: Aug. 19, 2008

(54) ATTACHMENT GUSSET WITH RUFFLED CORNERS AND SYSTEM FOR AUTOMATED MANUFACTURE OF SAME

(75) Inventors: Elvin C. Price, Dacula, GA (US); Preston B. Dasher, Lawrenceville, GA (US); John S. Chamlee, Lawenceville, GA (US); Van H. Nguyen, Lawrenceville, GA (US); Danny V. Murphy, Dacula, GA (US); George A. Price, Lawrenceville, GA (US); Stephen S. Ruderman, Lilburn, GA (US)

(73) Assignee: Atlanta Attachment Company, Lawrenceville, GA (US)

( * ) Notice: Subject to any disclaimer, the term of this patent is extended or adjusted under 35 U.S.C. 154(b) by 485 days.

(21) Appl. No.: 10/963,114

(22) Filed: Oct. 12, 2004

(65) Prior Publication Data

US 2005/0045081 A1 Mar. 3, 2005

Related U.S. Application Data

(63) Continuation of application No. 10/219,837, filed on Aug. 15, 2002, now Pat. No. 6,834,603.

(60) Provisional application No. 60/362,026, filed on Mar. 5, 2002.

(51) Int. Cl.
*D05B 1/00* (2006.01)
*D05B 35/08* (2006.01)

(52) U.S. Cl. ..... 112/475.08; 112/2.1

(58) Field of Classification Search ..... 112/2.1, 112/147, 152, 153, 275, 276, 176, 470.07, 112/475.08

See application file for complete search history.

(56) References Cited

U.S. PATENT DOCUMENTS

| | | | | |
|---|---|---|---|---|
| 1,947,058 | A | 2/1934 | Pittoni | 112/3 |
| 2,025,355 | A | 12/1935 | Mitchell | |
| 2,335,960 | A | 12/1943 | Patton | |
| 2,336,952 | A | 12/1943 | Olson | |
| 2,772,425 | A | 12/1956 | Brodie | |

(Continued)

FOREIGN PATENT DOCUMENTS

DE 31 39426 A1 4/1983

(Continued)

OTHER PUBLICATIONS

AAC's Complaint and Demand for Jury Trial.
AAC's Motion for Preliminary Injunction and Brief in Support.
L&P's Answer, Affirmative Defenses, and Counterclaims.
AAC's Initial Disclosures.

(Continued)

*Primary Examiner*—Ismael Izaguirre
(74) *Attorney, Agent, or Firm*—Womble Carlyle Sandridge & Rice, PLLC

(57) ABSTRACT

An apparatus for attaching a gusset to a panel includes a gusset folder that receives and folds a gusset material to form the gusset. The panel is supported by a sewing table. A sewing machine is positioned relative to the sewing table so as to be able to sew the gusset to the panel. A gusset guide guides the gusset toward a selected edge of the panel so that the gusset is held in substantial alignment with the edge of the panel. An edge detector detects when a next edge of the panel is approaching the sewing machine. A turning mechanism is positioned along the sewing table and is moveable into engagement with the panel. The turning mechanism turns the panel relative to the sewing machine when the edge detector detects the next edge of the panel is approaching the sewing machine.

56 Claims, 8 Drawing Sheets

U.S. PATENT DOCUMENTS

| | | | | |
|---|---|---|---|---|
| 2,945,238 | A | 7/1960 | Weiser | |
| 2,975,437 | A | 3/1961 | Freeman | |
| 3,013,513 | A | 12/1961 | Judelson | 112/203 |
| 3,109,182 | A | 11/1963 | Doak | |
| 3,190,247 | A | 6/1965 | Schifano et al. | |
| 3,641,954 | A | 2/1972 | Kalning et al. | 112/3 |
| 3,802,361 | A | 4/1974 | Block | |
| 4,013,026 | A | 3/1977 | Hall | 112/153 |
| 4,014,273 | A | 3/1977 | Kosakai | |
| 4,025,975 | A | 5/1977 | Phillips et al. | |
| 4,043,282 | A | 8/1977 | Fanghanel | 112/3 |
| 4,067,269 | A | 1/1978 | Fanghanel | 112/3 |
| 4,073,246 | A | 2/1978 | Crawford et al. | |
| 4,108,094 | A | 8/1978 | Weigert | |
| 4,115,886 | A | 9/1978 | Miller | 5/365 |
| 4,141,304 | A | 2/1979 | Masuda | 112/153 |
| 4,245,576 | A | 1/1981 | Crawford et al. | |
| 4,280,421 | A | 7/1981 | Price | |
| 4,290,376 | A | 9/1981 | Brusasca et al. | 112/121.26 |
| 4,424,600 | A | 1/1984 | Callaway | |
| 4,432,294 | A | 2/1984 | Price et al. | |
| 4,463,466 | A | 8/1984 | May et al. | 5/475 |
| 4,466,367 | A | 8/1984 | Price et al. | |
| 4,498,404 | A | 2/1985 | Sadeh | 112/121.12 |
| 4,527,492 | A | 7/1985 | Gill | |
| 4,644,883 | A | 2/1987 | Guin et al. | |
| 4,680,821 | A | 7/1987 | Maguire | |
| 4,691,651 | A | 9/1987 | Junemann | 112/259 |
| 4,703,706 | A | 11/1987 | Plante | 112/265.1 |
| 4,742,789 | A | 5/1988 | Pestel et al. | 112/262.3 |
| 4,776,579 | A | 10/1988 | Romand et al. | 271/228 |
| 4,794,873 | A | 1/1989 | Dordi et al. | 112/2.1 |
| 4,809,375 | A | 3/1989 | Bull | |
| 4,813,364 | A | 3/1989 | Boser | 112/304 |
| 4,821,656 | A | 4/1989 | Dordi et al. | 112/2.1 |
| 4,825,787 | A | 5/1989 | Babson et al. | 112/262.3 |
| 4,827,856 | A | 5/1989 | Rohr | 112/63 |
| 4,838,186 | A | 6/1989 | Resta et al. | 112/2.1 |
| 4,893,574 | A | 1/1990 | O'Neal et al. | |
| 4,905,615 | A | 3/1990 | Pofferi | 112/2.1 |
| 4,958,579 | A | 9/1990 | De Weers | 112/2.1 |
| 4,987,842 | A * | 1/1991 | Nakamura et al. | 112/275 |
| 4,998,965 | A | 3/1991 | Easom | 112/305 |
| 5,018,462 | A | 5/1991 | Brocklehurst | 112/121.12 |
| 5,042,098 | A | 8/1991 | Stultz | 5/495 |
| 5,134,947 | A | 8/1992 | Price et al. | |
| 5,137,190 | A | 8/1992 | Plaud | |
| 5,159,889 | A | 11/1992 | Price et al. | |
| 5,203,270 | A | 4/1993 | Price et al. | |
| 5,282,433 | A | 2/1994 | Freermann et al. | 112/153 |
| 5,285,542 | A | 2/1994 | West et al. | |
| 5,289,788 | A | 3/1994 | Fukumoto | 112/121.12 |
| 5,341,755 | A | 8/1994 | Kawasaki | 112/263 |
| 5,367,968 | A | 11/1994 | Diaz | 112/262.3 |
| 5,373,798 | A | 12/1994 | Price et al. | |
| 5,428,852 | A | 7/1995 | Tenuta et al. | |
| 5,437,238 | A | 8/1995 | Price et al. | |
| 5,475,881 | A | 12/1995 | Higgins et al. | |
| 5,482,318 | A | 1/1996 | Sollars, Jr. | |
| 5,501,164 | A * | 3/1996 | Porter et al. | 112/176 |
| 5,522,332 | A | 6/1996 | Price et al. | |
| 5,529,004 | A | 6/1996 | Porter et al. | |
| 5,542,775 | A | 8/1996 | Bechtoldt et al. | |
| 5,562,660 | A | 10/1996 | Grob | |
| 5,586,511 | A | 12/1996 | Porter et al. | |
| 5,634,418 | A | 6/1997 | Price et al. | |
| 5,645,002 | A | 7/1997 | Brocklehurst | |
| 5,647,293 | A | 7/1997 | Price et al. | |
| 5,655,241 | A | 8/1997 | Higgins et al. | 5/737 |
| 5,657,711 | A | 8/1997 | Price et al. | |
| 5,701,623 | A | 12/1997 | May | |
| 5,704,084 | A | 1/1998 | Evans et al. | 5/710 |
| 5,729,851 | A | 3/1998 | Hollander | |
| 5,743,202 | A | 4/1998 | Price et al. | |
| 5,769,015 | A | 6/1998 | Kato | |
| 5,778,811 | A | 7/1998 | Gill et al. | |
| 5,782,190 | A | 7/1998 | Porter et al. | 112/176 |
| 5,809,919 | A | 9/1998 | Mitchell et al. | 112/470.07 |
| 5,816,177 | A | 10/1998 | Brocklehurst | 112/470.05 |
| 5,865,135 | A | 2/1999 | Price et al. | |
| 5,899,159 | A | 5/1999 | Dasher et al. | |
| 5,908,004 | A | 6/1999 | Porter et al. | |
| 5,915,319 | A | 6/1999 | Price et al. | |
| 5,918,560 | A | 7/1999 | Dasher et al. | |
| 5,924,376 | A | 7/1999 | Olewicz et al. | |
| 5,970,548 | A | 10/1999 | Welch | 5/710 |
| 5,974,609 | A | 11/1999 | Nunez et al. | |
| 5,975,881 | A | 11/1999 | Langos et al. | |
| 5,979,345 | A | 11/1999 | Price et al. | |
| 6,000,352 | A | 12/1999 | Porter et al. | |
| 6,035,794 | A | 3/2000 | Keeton | |
| 6,041,456 | A | 3/2000 | Pharr | |
| 6,055,921 | A | 5/2000 | Olewicz et al. | |
| 6,088,858 | A | 7/2000 | Juster et al. | |
| 6,125,488 | A | 10/2000 | Vogland et al. | 5/739 |
| 6,129,030 | A | 10/2000 | Resta | |
| 6,202,579 | B1 | 3/2001 | Olewicz et al. | 112/2.1 |
| 6,263,532 | B1 | 7/2001 | Miller | |
| 6,279,869 | B1 | 8/2001 | Olezicz | |
| 6,293,213 | B1 | 9/2001 | Block et al. | 112/470.5 |
| 6,295,481 | B1 | 9/2001 | Price | |
| 6,408,773 | B2 | 6/2002 | Resta | |
| 6,530,335 | B1 | 3/2003 | Halfmann et al. | |
| 6,532,608 | B2 | 3/2003 | Schreiner | 5/497 |
| 6,574,815 | B2 | 6/2003 | Freeman et al. | 5/716 |
| 6,715,173 | B2 | 4/2004 | Barman et al. | |
| 6,721,982 | B2 | 4/2004 | Freeman | |
| 6,760,935 | B1 | 7/2004 | Burton et al. | |
| 6,802,271 | B2 | 10/2004 | Oxley et al. | |
| 6,834,603 | B1 * | 12/2004 | Price et al. | 112/470.07 |
| 6,874,215 | B2 | 4/2005 | Flippin | |
| 6,883,446 | B2 * | 4/2005 | Koerner | 112/272 |
| 6,889,622 | B2 | 5/2005 | Marcangelo | |
| 7,021,227 | B2 | 4/2006 | Marcangelo | |
| 7,100,525 | B1 * | 9/2006 | Price et al. | 112/475.08 |
| 2001/0032361 | A1 | 10/2001 | Schreiner | 5/497 |
| 2002/0050117 | A1 | 5/2002 | Dasher et al. | 53/117 |
| 2004/0129189 | A1 | 7/2004 | Oxley et al. | |

FOREIGN PATENT DOCUMENTS

| | | |
|---|---|---|
| DE | 37 12493 A1 | 5/1987 |
| EP | 0264 618 A1 | 4/1988 |
| EP | 0 200 368 B1 | 10/1990 |
| GB | 1384073 | 2/1975 |
| WO | WO 92/12282 | 7/1992 |
| WO | WO 95/25194 | 9/1995 |
| WO | WO 02/065877 | 8/2002 |

OTHER PUBLICATIONS

AAC's Responses and Objections to Defendant L&P's First Set of Interrogatories.
AAC's Responses and Objections to Defendant L&P's First Set of Requests for Production of Documents.
L&P's Initial and Revised Initial Disclosures.
L&P's Invalidity Contentions.
AAC's Reply to L&P's Counterclaims.
AAC's and L&P's Joint Claim Construction Statement.
AAC's Supplemental Responses and Objections to Defendant L&P's Interrogatory No. 5.
AAC's Supplemental Responses and Objections to Defendant L&P's Interrogatory No. 17.
AAC's and L&P's Joint Preliminary Report and Scheduling Order.
L&P's Opening Claim Construction Brief.

AAC's Opening Claim Construction Brief.
L&P's Responsive Claim Construction Brief.
AAC's Response to L&P's Opening Claim Construction Brief.
L&P's Opposition to AAC's Motion for Preliminary Injunction (Redacted).
Declaration of Thomas Sanfilippo.
Expert Report of Dale Lischer.
L&P's Supplemental Opposition to Motion for Preliminary Injunction.
L&P's Supplemental Invalidity Contentions.
AAC's Reply Brief in Support of its Motion for Preliminary Injunction (Redacted).
L&P's Motion (1) For Leave To File Attached Sur-reply Brief in Response to Plaintiff's Reply To Defendant's Oppsition To Plaintiff's Motion For Preliminary Injunction Or (2) Alternatively, To Strike Declarations and Brief in Support Thereof.
AAC's Brief In Opposition to Defendant L&P's Motion (1) for Leave to File Sur-reply or (2) Alternatively to Strike Declarations (Attached L&P Brief is Redacted).
Initial, Supplemental, and Second Supplemental Declarations of Ben Kuchel (Second Supplemental Declaration of Ben Kuchel is Redacted).
GPT-1000 Video (Jan. 2003) (LP3916).
Global Systems Catalog Group Video Catalog (LP3917).
AAC Invoices (AAC299-301; AAC320-326; AAC2870; AAC93; AAC109-114; AAC124-134; and AAC2869).
AAC Model 1325 Ruffler (Web page brochure).
Mattress Photos (LP763-781).
Andersen, "Leggett & Platt, Incorporated's Notice of Manual Filing of Exhibit "A" to Declaration of Gordon Billheimer in Support of its Request based on Newly Discovered Evidence of Non-Patent Prior Art for Reconsideration of Order Granting Summary Judgment to Atlanta Attachment Company on Validity of '603 Patent;" *Atlanta Attachment Company* v. *Leggett & Platt, Incorporated*, Civil Action No. 1:05-CV-1071-ODE; Oct. 9, 2007.
Andersen, "Request Based on Newly Discovered Evidence of Non-Patent Prior Art for Reconsideration of Order Granting Summary Judgment to Atlanta Attachment Company on Validity of '603 Patent," *Atlanta Attachment Company* v. *Leggett & Platt, Incorporated*, Civil Action No. 1:05-CV-1071-ODE; Oct. 9, 2007.
Stratton, "Affidavit of Stephen Stratton," *Atlanta Attachment Company* v. *Leggett & Platt, Incorporated*, Civil Action No. 1:05-CV-1071-ODE, Oct. 8, 2007.
Andersen, "Declaration of Donald R. Andersen," *Atlanta Attachment Company* v. *Leggett & Platt, Incorporated*, Civil Action No. 1:05-CV-1071-ODE, Oct. 9, 2007.
Andersen, "Supplemental Declaration of Donald R. Andersen" *Atlanta Attachment Company* v. *Leggett & Platt, Incorporated*, Civil Action No. 1:05-CV-1071-ODE, Nov. 19, 2007.
Billheimer, JR., "Declaration of Gordon E. Billheimer, Jr.," *Atlanta Attachment Company* v. *Leggett & Platt, Incorporated*, Civil Action No. 1:05-CV-1071-ODE, Oct. 9, 2007.
Stratton, "Leggett & Platt, Incorporated's Notice of filing of the affidavit of Stephen Stratton in Support of its Request Based on Newly Discovered Evidence of Non-Patent Prior Art for Reconsideration of Order Granting Summary Judgment to Atlanta Attachment Company on Validity of '603 Patent," *Atlanta Attachment Company* v. *Leggett & Platt, Incorporated*, Civil Action No. 1:05-CV-107-ODE, Oct. 10, 2007.
Andersen, "Leggett & Platt, Incorporated's Notice of Filing of the Affidavit of Reinhard Kunstler in Support of its Request Based on Newly Discovered Evidence of Non-Patent Prior Art for Reconsideration of Order Granting Summary Judgment to Atlanta Attachment Company on Validity of '603 Patent," *Atlanta Attachment Company* v. *Leggett & Platt, Incorporated*, Civil Action No. 1:05-CV-1071-ODE, Oct. 10, 2007.
Andersen, Leggett & Platt, Incorporated's Notice of Manual Filing of Electronic Media of Exhibits "D," "E-1," and "E-2" to the Declaration of Volker Wissing in Support of its Renewed and Amended Request Based on Newly Discovered Evidence of Non-Patent Prior Art for Reconsideration of Order Granting Summary Judgment to Atlanta Attachment Company on Validity of '603 Patent, *Atlanta Attachment Company* v. *Leggett & Platt, Incorporated*, Civil Action No. 1:05-CV-1071-ODE, Nov. 19, 2007.
Andersen, Renewed and Amended Request Based on Newly Discovered Evidence of Non-Patent Prior Art for Reconsideration of Order Granting Summary Judgment to Atlanta Attachment Company on Validity of '603 Patent, *Atlanta Attachment Company* v. *Leggett & Platt, Incorporated*, Civil Action No. 1:05-CV-1071-ODE, Nov. 19, 2007.
Evans, "Order," *Atlanta Attachment Company* v. *Leggett & Platt, Incorporated*, Civil Action No. 1:05-CV-1071-ODE, Oct. 18, 2007.
Ullrich, "Declaration of Don Ullrich," *Atlanta Attachment Company* v. *Leggett & Platt, Incorporated*, Civil Action No. 1:05-CV-1071-ODE, Nov. 18, 2007.
Stratton, "Amended Affidavit of Stephen Stratton," *Atlanta Attachment Company* v. *Leggett & Platt, Incorporated*, Civil Action No. 1:05-CV-1071-ODE, Oct. 18, 2007.
Wissing, "Declaration of Voker Wissing," *Atlanta Attachment Company* v. *Leggett & Platt, Incorporated*, Civil Action No. 1;05-CV-1071-ODE, Nov. 19, 2007.
Andersen, Leggett & Platt, Incorporated's Notice of Supplemental Filing to the Declaration of Donald R. Andersen in Support of its Renewed and Amended Request Based on Newly Discovered Evidence of Non-Patent Prior Art for Reconsideration of Order Granting Summary Judgment to Atlanta Attachment Company on Validity of '603 Patent; *Atlanta Attachment Company* v. *Leggett & Platt, Incorporated*, Civil Action No. 1:05-CV-1071-ODE, Nov. 27, 2007.
Ward, "Atlanta Attachment Company's Response in Opposition to Leggett & Platt, Inc.'s Renewed and Amended Request Based on Newly Discovered Evidence of Non-Patent Prior Art for Reconsideration of Order Granting Summary Judgment to Atlanta Attachment Company on Validity of '603 Patent;" *Atlanta Attachment Company* v. *Leggett & Platt, Incorporated*, Civil Action No. 1:05-CV-1071-ODE, Dec. 7, 2007.
Andersen, "Reply Brief in Support of Renewed and Amended Request Based on Newly Discovered Evidence of Non-Patent Prior Art for Reconsideration of Order Granting Summary Judgment to Atlanta Attachment Company on Validity of '603 Patent," *Atlanta Attachment Company* v. *Leggett & Platt, Incorporated*, Civil Action No. 1:05-CV-1071-ODE, Dec. 27, 2007.
Andersen, Leggett & Platt, Incorporated's Notice of Electronic Filing of Supplemental Declarations in Support of its Reply Brief in Support of its Renewed and Amended Request Based on Newly Discovered Evidence of Non-Patent Prior Art for Reconsideration of Order Granting Summary Judgment to Atlanta Attachment Company on Validity of '603 Patent; *Atlanta Attachment Company* v. *Leggett & Platt, Incorporated*, Civil Action No. 1:05-CV-1071-ODE, Dec. 27, 2007.
Andersen, "Leggett & Platt, Incorporated's Notice of Electronic Filing of Declaration of Translation Relating to the Brochure for the Matubara AR-880 PC Sewing Machine;" *Atlanta Attachment Company* v. *Leggett & Platt, Incorporated*, Civil Action No. 1:05-CV-1071-ODE; Dec. 27, 2007.
Andersen, Leggett & Platt, Incorporated's Notice of Manual Filing of Electronic Media of Exhibits "A," "B," and "C" to the Declaration of David Elsdon Relating to Newly Discovered Evidence of 1976 Singer Futura Sewing Machine and Ruffling Attachment; *Atlanta Attachment Company* v. *Leggett & Platt, Incorporated*, Civil Action No. 1:05-CV-1071-ODE; Dec. 27, 2007.
Andersen, Leggett & Platt, Incorporated's Notice of Electronic Filing of Affidavits and Declaration Relating to Newly Discovered Evidence of 1976 Singer Futura Sewing Machine and Ruffling Attachment; *Atlanta Attachment Company* v. *Leggett & Platt, Incorporated*, Civil Action No. 1:05-CV-1071-ODE; Dec. 27, 2007.
Andersen, "Leggett & Platt, Incorporated's Notice of Electronic Filing of Affidavits and Declaration Relating to Newly Discovered Evidence of 1976 Singer Futura Sewing Machine and Ruffling Attachment;" *Atlanta Attachment Company* v. *Leggett & Platt, Incorporated*, Civil Action No. 1:05-CV-1071-ODE; Dec. 27, 2007.
*Atlanta Attachment Company* v. *Leggett & Platt, Incorporated*, No. 2007-1188, 2008 WL 450568 (Fed. Cir. Feb. 21, 2008).

* cited by examiner

ATTACHMENT GUSSET WITH RUFFLED CORNERS AND SYSTEM FOR AUTOMATED MANUFACTURE OF SAME

CROSS REFERENCE TO RELATED APPLICATIONS

This patent application is a continuation of U.S. patent application Ser. No. 10/219,837, now U.S. Pat. No. 6,834,603, filed Aug. 15, 2002, and entitled "Attachment Gusset with Ruffled Corners and System for Automated Manufacture of Same," which claims the benefit of U.S. Provisional Application Ser. No. 60/362,026, filed Mar. 5, 2992, the entirety of which are hereby incorporated by reference.

BACKGROUND OF THE INVENTION

The present invention relates to sewn articles and sewing operations and, more particularly, to sewn attachment of different pieces of material by gussets.

In the sewn construction of padded articles, such as mattresses and furniture cushions, a padded layer or layers may be enclosed in upholstery and attached by a gusset to an accompanying pad or spring unit. For example, in a pillow-top style mattress, a pillow-top is attached to a panel by a gusset, which in one form is a folded band of material sewn along a fold line of the panel, and then sewn to a flange (which is subsequently stapled to the mattress) along the first edge opposite the fold and sewn to the pillow-top along the second edge opposite the fold, thereby attaching the pad to the mattress. At corners of the panel to which the gusset is sewn, the gusset is mitered at a seam to allow the gusset to turn the ninety degree corner of the mattress. The mitering of the gusset at the corners requires at least one miter cut to be made in the gusset at each right angle corner of the adjoining panel. Each of the mitered corner cuts must be precisely measured and individually sewn so that the gusset forms a closed structure between the mattress and the pillow-top. In a manual assembly process, the gusset is separately constructed by sewing together each leg of the gusset at the mitered corners to form a gusset frame which matches the mattress panel. The gusset is then sewn to the edges of the panel of the mattress by a tape edge. Thereafter, the pillow-top is attached to the other free edge of the gusset by a second tape edge. If the miter cuts at the corners of the gussets are not made at the correct angles, the gusset corner will not have a smooth contour or appearance. Also, in articles where the gusset remains visible, the multiple seams in the gusset are unsightly and vulnerable to separation. Constructing a gusset this way is a tedious manual production process which adds significantly to the cost of producing pillow-top mattresses and similar sewn articles.

Therefore, there is a need for a mattress having a continuously cornered gussets. There is also a need for a system for producing mattresses having continuously cornered gussets. There is also a need for a system that combines the process for sewing the flange and the gusset to the panel, or for a system that eliminates the need for a flange.

SUMMARY OF THE INVENTION

The disadvantages of the prior art are overcome by the present invention which, in one aspect, is an apparatus for attaching a gusset to a panel that includes a gusset folder that receives and folds a gusset material to form the gusset from attachment to the panel. The panel is received on and supported for sewing by a sewing table. A sewing machine is positioned relative to the sewing table so as to be able to sew the gusset to the panel. A gusset guide guides the gusset fed to the sewing machine toward a selected edge of the panel so that the gusset is held in substantial alignment with the edge of the panel. An edge detector detects when a next edge of the panel is approaching the sewing machine. A turning mechanism is positioned along the sewing table and is moveable into engagement with the panel. The turning mechanism turns the panel relative to the sewing machine when the edge detector detects the next edge of the panel is approaching the sewing machine.

In another aspect, the invention is a method of sewing a gusset to a panel, in which the gusset is sewn to the panel along a first substantially linear path with a sewing machine. A corner of the panel is detected. The panel is turned when the corner of the panel approaches the sewing machine so that the gusset follows a curved path adjacent the corner of the panel. The gusset is sewn to the panel along a second substantially linear path, angularly divergent from the first substantially linear path, after the gusset has been sewn around the corner of then panel.

In another aspect, the invention is an apparatus for sewing a gusset and a flange to a panel. The apparatus includes a first reel holding a gusset material and a second reel holding a flange material. A folding device folds the gusset material from the first reel along a substantially linear path. A first sewing machine receives the gusset material from the folding device and the flange material from the second reel and sews the gusset material to the flange material, thereby forming a gusset-flange. A second sewing machine receives the gusset-flange from the first sewing machine and sews the gusset-flange to the panel.

In another aspect, the invention is a gusset for attachment to a panel that has at least one first corner. The gusset includes a strip of gusset material having a first edge and a second edge. The strip of gusset material is folded substantially along a centerline and the first edge of the gusset material is sewn to the first panel. The gusset defines at least one pleat that causes the gusset material to change direction. The pleat is placed adjacent to the first corner.

In another aspect, the invention is a mattress having a first panel over one side of a mattress inner-spring. The mattress includes a gusset attached substantially about a perimeter of the first panel. The gusset is made of an elongated piece of material folded along a length dimension. The gusset is attached to the first panel proximate to a fold in the gusset material. A first edge of the gusset opposite the fold is attached to a perimeter of the first panel. A second edge of the gusset is adapted for attachment to a second panel. The gusset includes at least one corner that has at least one pleat forming a ruffled gusset corner.

In another aspect, the invention is an outer layer for attaching a pillow-top to a mattress that includes a panel having at least one outer end. A gusset includes a strip of gusset material that has a first edge and an opposite second edge and that has been folded substantially in half along a fold line so the first edge is substantially adjacent the second edge. The gusset is sewn to the panel along a line adjacent the fold line and near the outer end of the panel so that the outer end extends beyond the first end and so that the second edge has sufficient distance to provide an attachment surface on the panel to enable attaching the outer layer to the mattress.

These and other aspects of the invention will become apparent from the following description of the preferred embodiments taken in conjunction with the following drawings. As would be obvious to one skilled in the art, many variations and modification of the invention may be affected without departing from the spirit and scope of the novel concepts of the disclosure.

DETAILED DESCRIPTION OF THE INVENTION

Figure 1:
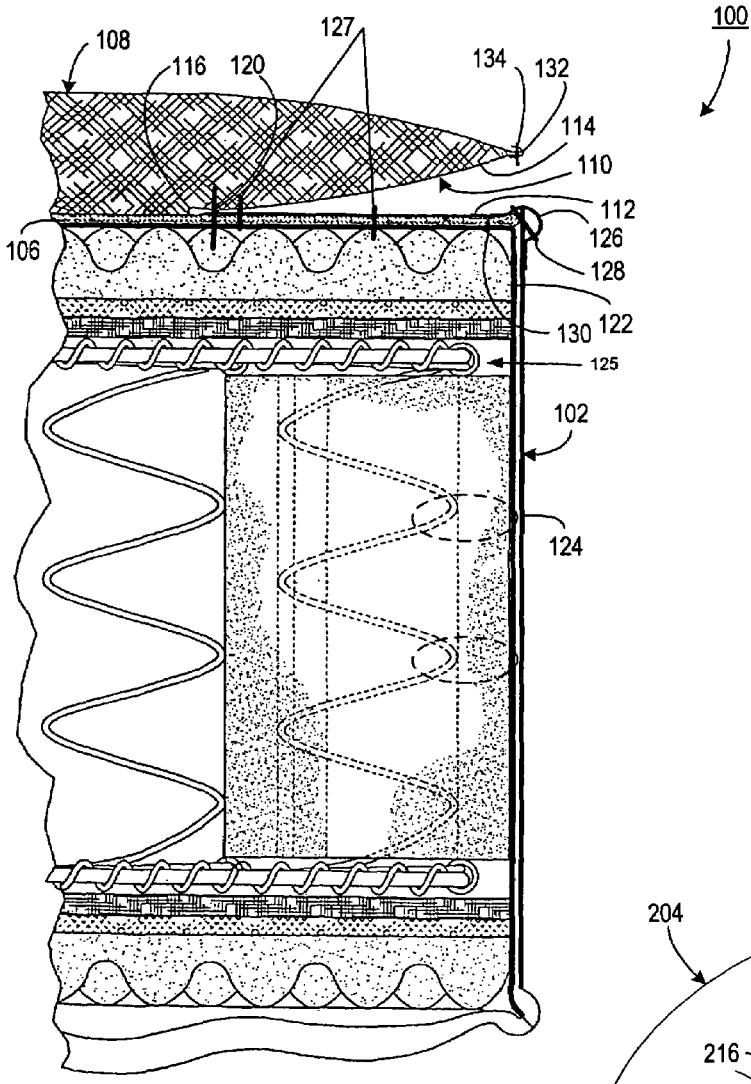
FIG. 1 is a cross-sectional view of a mattress constructed according to an illustrative embodiment of the invention.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on."

Typical mattresses having a covering material encapsulating an innerspring construction or assembly are generally known in the art. The major parallel and opposed sides of the mattress are covered by respective panels. The panels may include multiple layers, such as an internal layer directly overlying the innerspring, and an upholstered exterior layer, which is commonly quilted. The so-called "pillow-top" style mattress further includes a separately encapsulated padding layer or pillow-top which covers one or both panels. Different ways of attaching the pillow-top to the mattress have been devised, with the most common construction being sewn attachment about the perimeter of each panel. Because the pillow-top has a substantial thickness dimension, e.g. several inches in cross-section, attachment to the panels at the perimeter requires a gusset which reaches from the panel perimeter to the tapered edge of the pillow-top.

As shown in FIG. 1, a pillow-top mattress 100, according to one illustrative embodiment of the invention, includes a main mattress body 102 and a pillow-top portion 108 attached to the mattress body 102 with a gusset 110. The gusset 110 is folded in half along a centerline 116 and sewn to a panel 106 along a stitch line 120 so as to have a first edge 112 and a second edge 114. Generally, the gusset 110 is made from a strip of material, e.g., mattress upholstery material. A strip of flange material 122 is sewn to the periphery of the panel 106, along stitch line 120. The flange is also attached to the first edge 112 by stitches 127. The flange material 122 extends from the outermost edge of the panel 106 and is stapled to a spring unit 125 of the mattress body 102. A strip of fabric tape 126 is sewn to the first edge 112, along stitch line 128, the side wall 124 along stitch line 128, thereby securing the gusset 110 to the mattress body 102.

The second edge of the gusset is aligned with the outermost edge of the pillow-top 108 and a strip of fabric tape 132 is sewn around the junction of the gusset 110 and the pillow-top 108 along a stitch line 134, thereby securing the panel 106 (and thus the mattress body 102) to the pillow-top.

Figure 2:
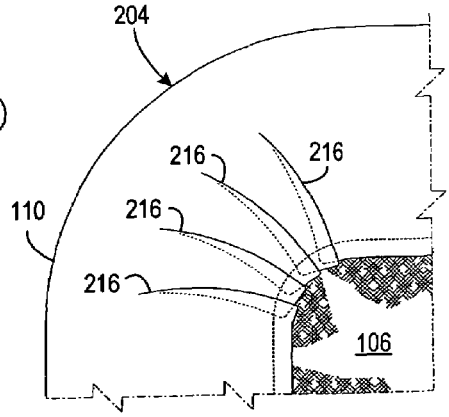
FIG. 2 is a top plan view of a portion of a ruffled gusset according to an illustrative embodiment of the invention.

As shown in FIG. 2, as the gusset 110 is being sewn to the panel 106, when a corner 204 of the panel 106 nears the point of sewing, a plurality of ruffles 216 are stitched into the gusset 110 so that the gusset 110 is a continuous piece of gusset material. This eliminates the need for mitering the gusset material.

The corners of the gusset 110 are formed as a radial bend, which matches the curvature of the underlying panel 106, which in this case is a ninety degree turn, although the invention is applicable to any degree turn which may be required to attach a gusset 110 to a panel 106. To form the radial bend, one or more pleats 216 (also referred to as ruffles 216) are formed in the gusset 110 at the fold and secured to the panel 106 by stitches. When formed in series about the radiused corner, the pleats 216 are collectively referred to as a ruffle, or ruffled corner. The ruffled corner avoids having to make a mitered seam, whereby the gusset 110 remains a continuous band of material around each curve or corner of a panel 106. This gusset 110 construction is suited for automated attachment of the gusset 110 to a panel 106 about an entire perimeter of the panel 106, and eliminates the step of having to pre-manufacture the gusset 110 before the attachment.

The invention thus provides a gusset 110 wherein turns, curves or corners of the gusset 110 are ruffled by one or more pleats 216 formed in one edge of the gusset 110 material. The pleats 216 are sewn in place to an underlying panel 106, and an opposite edge of the gusset 110 is also sewn to a panel 106. In the pillow-top example, one of the opposite edges of the gusset 110 (e.g., the edge opposite to the fold) is sewn to the perimeter of the mattress panel 106 by a flange. The other edge is sewn to the pillow-top edge by a flange. Other attachment arrangements are within the conceptual scope of the invention, in which pleats 216 are formed on one side of the gusset 110 to provide a continuous gusset 110 with changes in direction according to the number, size and spacing of the pleats 216 and the resulting gusset 110.

In an embodiment of the present invention, the gusset 110 is attached to a panel 106 having at least one first corner 204. The gusset 110 comprises a strip of gusset material having a first edge 112 and a second edge 114. The strip of gusset material can be sewn to the panel 206, such that the gusset 110 defines at least one pleat 216 that causes the gusset material to change direction. Generally, the at least one pleat 216 is placed adjacent to the one first corner 204 of the panel 106. Further, the at least on pleat 216 extends partially across a width of the gusset material. The gusset 110, however, can include at least one pleat 216 that does not extend across an entire width of the gusset material.

As shown in FIG. 2, a pleat 216 is a fold in cloth or other material made by doubling the material upon itself and then pressing or stitching the pleat 216 into place, thereby resulting in the creation of a pleat edge presenting a neat, orderly appearance as shown. Each pleat 216 has a folded base end of variable length, and upper and lower pleat folds which extend across a width of the gusset material from the gusset fold toward gusset edges 112, 114. The pleats 216 can be created when the gusset 110 is doubled upon itself and stitched into place with stitches.

The gusset 110 can further comprise a plurality of pleats 216 forming a ruffled corner, whereby the direction of the gusset material is altered by substantially ninety-degrees. The plurality of pleats 216 can be substantially evenly spaced along the gusset 110. Moreover, the gusset material is continuous about a perimeter of the panel 106 after attachment.

A mattress 102 can be attached to the panel 106, whereby the gusset 110 is also attached to the mattress 102 via the panel 106. Accordingly, the gusset material can be made of a mattress upholstery material. For example, the mattress 102 can have a first panel over one side of a mattress inner-spring, such that the mattress 102 comprises a gusset 110 attached substantially about a perimeter of the first panel. The gusset 110 is made of an elongated piece of material folded along a length dimension. The gusset 110 is attached to the first panel proximate to a fold in the gusset material. A first edge 112 of the gusset opposite the fold can be attached to a perimeter of the first panel 106, while a second edge 114 of the gusset 110 is adapted for attachment to a second panel. Further, the gusset 110 includes at least one corner that has at least one pleat 216 forming a ruffled gusset corner.

A ruffled gusset corner is a radial bend in the gusset formed by one or more pleats 216 in the gusset 110. A ruffle is typically a series of small folds made in a piece of cloth or other material or sewn therein. For example, a ruffle can be a plurality of pleats about a radiused corner of the panel 106. At the corners 204 of the panel 106, a series of pleats 216 are formed at the fold of the gusset 110 to create a ruffled ninety degree corner which matches the curvature of the underlying panel 106. The corners of the gusset 110 are formed as a radial bend, which matches the curvature of the underlying panel 106. To form the radial bend, one or more pleats 216 are formed in the gusset 110 at the fold and secured to the panel 106 by stitches. When formed in series about the radiused corner, the pleats 216 are collectively referred to as a ruffle, or ruffled corner.

The at least one pleat 216 at the corner of the gusset 110 can be sewn to the first panel 106. Each corner of the gusset 110 can also include a plurality of substantially evenly spaced pleats 216. And the at least on pleat 216 at the one corner of the gusset 110 can extend partially across the width of the gusset material. Also, the gusset 110 can be attached to the first panel along a line that is spaced apart from a perimeter of the first panel.

The second edge 114 of the gusset 110, therefore, can be attached to a perimeter of a mattress pillow-top 108. More specifically, an outer layer for attaching a pillow-top 108 to a mattress 102 can comprise a panel 106 having at lest one outer end and a gusset 110. The gusset 110 generally comprises a strip of gusset material having a first edge 112 and an opposite second edge 114 and that has been folded substantially in half along a fold line so the first edge 112 is substantially adjacent the second edge 114. The gusset 110 can be sewn to the panel 106 along a line adjacent the fold line and near the outer end of the panel 106, so that the outer end extends beyond the first edge 112 and the second edge 114, with sufficient distance to provide an attachment surface on the panel 106 to enable attaching the outer layer to the mattress 102.

Figure 3:
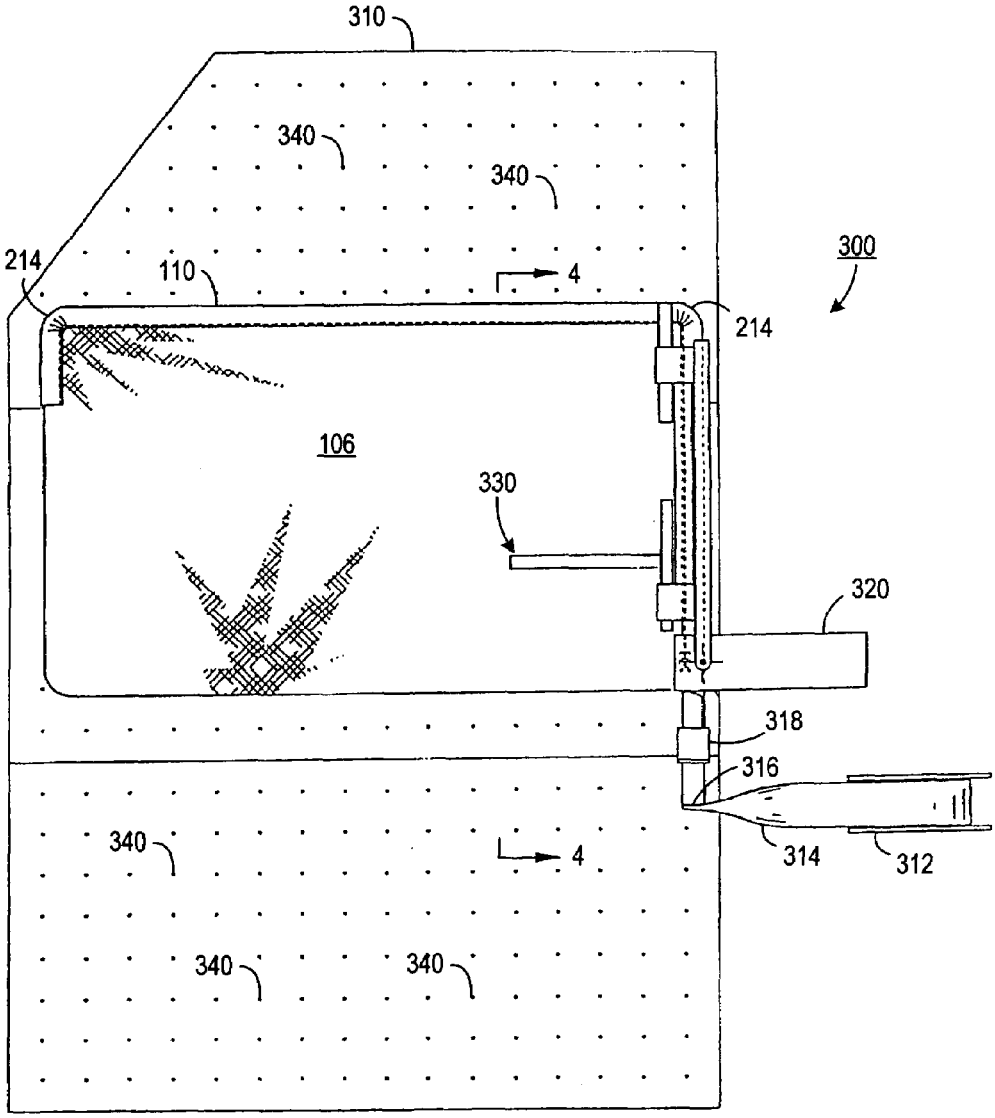
FIG. 3 is a top plan view of a gusset manufacturing machine according to an illustrative embodiment of the invention.

A gusset sewing system 300 is shown in FIG. 3. The gusset sewing system 300 of the present invention is adapted to attach a gusset 110 to a mattress panel 106, such that the gusset sewing system 300 can detect approaching corners 204 of the mattress panel 106 and turn the mattress panel 106 as necessary to continue sewing another side of the mattress panel 106. Accordingly, the gusset sewing system comprises a gusset folder 316 (e.g., gusset folding device 316), a sewing table 310, a sewing machine 320, a gusset guide 450, an edge detector, and a turning mechanism 330. The gusset folder 316 is adapted to receive and fold provided gusset material, from a supply reel 312 for the gusset material, to form the gusset 110 to be attached to a mattress panel 106. The sewing table 310 can receive and support the mattress panel 106 to which the gusset material will be attached. The sewing machine 320 is positioned relative to the sewing table 310 so that the sewing machine 320 is able to sew the gusset material to the panel 106. The gusset guide 450 is adapted to guide the provided gusset material toward a selected edge of the panel 106 so that the gusset 110 is held in substantial alignment with the edge of the panel 106. The edge detector can detect when a next edge of the panel 106 is approaching the sewing machine 320. The turning mechanism 330 is positioned along the sewing table 310 and can move to engage the panel 106 to turn the panel 106 relative to the sewing machine 320, when the edge detector detects the next edge of the panel 106 is approaching the sewing machine 30.

The gusset sewing system 300 can further comprise a pleat generator 318 (also referred to as a ruffler 318), such that the pleat generator 318 can selectively form a pleat 216 into a portion of the gusset material as the gusset 110 is being sewn to the panel 106 by the sewing machine 320. Generally, the pleat generator 318 forms pleats 216 into the gusset 110 when the turning mechanism 330 turns the panel 106 after the edge detector detects the approaching next edge (e.g., the corner 204) of the panel 106.

A pleat generator 318 may be an independent device that forms a pleat 216 at a location chosen by the gusset sewing system 300, such s by the ruffler controller (system controller), in an operation timed with the sewing machine 320. Unlike prior art rufflers that were mechanically, physically attached to a sewing machine, the pleat generator 318 can operate independently from the sewing machine 320 in certain embodiments. That is, the pleat generator 318 detached and not physically coupled to the motor of the sewing machine 320. The pleat generator 318 is, therefore, driven by a separate motor than that of the sewing machine 320. Accordingly, pleats 216 can be generated and placed precisely where the mattress manufacturer desires. As the pleat generator 318 and sewing machine 320 are driven by separate and independent motors, the operation of the pleat generator 318 is timed or coordinated with the sewing machine 320 so that when a pleat 216 is generated at a desired location, such that the proper sewing operation can be performed. Additionally, the timing or coordination of the pleat generator 318 and sewing machine 320 prevents damage occurring to a pleating blade 440 of the pleat generator 318 or a sewing needle 442 of the sewing machine 320.

The pleat generator 318 comprises a pleat formation blade 440 (also referred to as a ruffler foot 440) that is coupled to the sewing machine 320 and movable in timed relation to the sewing of the gusset material, such that the pleat formation blade 440 engages and forms at least one pleat 216 in the gusset 110 as the panel 106 is turned by the turning mechanism 330, thereby forming a ruffled gusset corner on the panel 106. The pleat formation blade 440 has a first position and a spaced apart second position and an actuator (also referred to as the plunger assembly 446) that selectively moves the pleat formation blade 440 between the first position and the second position. The pleat formation blade 440 is adapted to form a pleat 216 in the gusset material, when the pleat formation blade 440 moves from the first position to the second position.

The pleat generator 318 can further comprise a sewing machine state sensor and a ruffler controller. The sewing machine state sensor (e.g., optical device or electronic eve) is adapted to generate a signal indicative of a position of the sewing needle 442. The ruffler controller is adapted to activate the actuator 446 to move the pleat formation blade 440 to the second position, when the sewing machine state sensor indicates that the sewing needle 442 is moving to an upward position.

In one embodiment of the present invention, an external rotor can rotate as the sewing needle 442 moves upward and downward. The sewing machine state sensor can comprise an optical sensor directed to the external rotor and a reflective material disposed on a predetermined position on the external rotor, such that the external rotor moves the reflective material to a predetermined position whereby the optical sensor can sense movement of the reflective material (and thereby the sewing needle 442).

Further, the sewing machine 320 can comprise a sewing machine controller that is coupled to the ruffler controller, such that the sewing machine controller is adapted to control the sewing machine 320, thereby causing the sewing machine 320 to operate at a relatively fast rate when the pleat generator 318 is not operating, but cause the sewing machine 320 to operate at a relatively slow rate when the pleat generator 318 is operating. Accordingly, the sewing machine 320 and the pleat generator 318 are controlled independently, but are interactive with one another.

In one embodiment of the present invention, the operation of the sewing machine 320 is monitored, such that a signal is provided to the pleat generator 318 to operate in timed relation with the sewing machine 320. To facilitate the operational control of the sewing and pleating process having a timed relation, a system controller is utilized to determine when the pleat generator 318 should start the pleating process, which requires a lower sewing speed.

The pleat generator 318 is controlled, such as by the ruffler controller, so that the pleat generator 318 pushes the gusset material in (e.g., creates a pleat 216) when the needle 442 of the sewing machine 320 is in an up position. Further, the pleat generator 318 pushes the gusset material out when the needle 442 of the sewing machine 320 is in a down position. Accordingly, the pleat blade 440 and the sewing needle 442 do not interfere with each other during operation.

The pleat generator 318, therefore, times its operation with the sewing machine 320 by electronically detecting the status of the sewing machine 320 to ensure the generation of a pleat 216 at a specific desired location. As the pleat generator 318 can be set to create any number of pleats 216, sizes, and spacing, the generation of the pleat 216 is variable depending on the specific selection. As configured, the operation of the pleat generator 318 is adjusted to conform to the desired parameters, thereby ensuring that the pleats 216 are generated at the desired locations corresponding with the selected parameters. To adjust operation, the pleat generator 318 electronically senses the operation of the sewing machine 320.

A system controller may be any electrical or mechanical element or group of elements that control the operations of the sewing and pleating process, whereby the sewing and pleating process is enabled to sew and pleat at varying rates and times without operator intervention. The system controller is adapted to control the sewing operation for attaching the gusset 110 to the panel 106, such that the system controller can control the rate of sewing of the gusset 110 to the panel 106. Accordingly, the system controller can vary the rate of sewing by the sewing machine 320 to enable high-speed sewing an a different rate of sewing for generation of the pleats 216 as needed. The system controller, therefore, can include programming for controlling the sewing of the gusset 110 to the panel 106 at varying rates and enabling generation of pleats 216, as needed, during the sewing process.

As the pleating generator 318 and sewing machine 320 are separately controlled, multiple system controllers may be used or, alternatively, the system controller can simultaneously control the pleating generator 318 and sewing machine 320 independently of each other. Indeed, the pleating blade 440 of the pleat generator 318 is controlled independently of the drive belt, thereby permitting the sewing process to operate at varying rates to the number of pleats 216 being formed. For example, the sewing speed of the sewing machine 320 can vary upon the operation of the ruffler 318, such that when the ruffler 318 is on, the sewing speed is slow and when the ruffler 318 is off, the sewing speed is fast. The drive belt is driven by rollers at a much higher rate as the gusset 110 is sewn along a straight line, as compared to the corners at which the combined operations of the panel turning and the ruffle formation (by extension and retraction of the pleating blade 440) are performed. In one embodiment of the present invention, the system controller is in communication with the optical device (such as an electronic eve), so that the system controller can regulate the operation of the pleat generator 318 based on the observational operation of the sewing machine 320.

Pleats 216 are created at a location designated by the gusset sewing system 300, such as through a system controller. More particularly, the gusset 110 is sewn to the panel 106 along a second substantially linear path that is angularly divergent from a first substantially linear path. The pleat generator 318 can be controlled so that the pleat generator 318 can create plans 216 at a desired time relative to the sewing of the pleats 216 in accordance with some embodiments. As the pleating blade 440 (or foot) is actuated independent of the drive belt, the pleat generator 318 enables selective design of the ruffle pattern, e.g., the number of pleats 216, relative to the rate at which the gusset material is drawn and sewn to the panel 106. Further, other attachment arrangements of the gusset sewing system 300 are within the conceptual scope of the invention, in which pleats 216 are formed on a side of the gusset 110 to provide a continuous gusset 110 with changes in direction according to the number, size, and spacing of the pleats 216 and the resulting gusset 110. Accordingly, by independently operating the pleat generator 218 from the sewing operation, flexibility in creating variable designs in the gusset 110 is achieved. The pleat generator 318 creates pleats 216 into the gusset 110 at varying or desired locations depending on the desired configuration of the pleats 216 (e.g., size, spacing, and number as programmed in the gusset sewing system 300).

In another embodiment, the gusset sewing system 300 comprises a gusset forming station, a sewing table 310, a sewing machine 320, a pleat generator 318, and a system controller. The gusset forming station is configured for automatically forming the gusset 110 from a strip of gusset material. The sewing table 310 has an upper surface for supporting the panel 106 as the gusset 110 is sewn thereto. Accordingly, the sewing machine 320 is positioned adjacent the upper surface of the sewing table 310, such that the sewing machine 320 is positioned along a sewing path for the panel 106. The sewing machine 320 is adapted to attach the gusset 110 to the panel 106 as it passes along the path. The pleat generator 318 is adapted to form at least one pleat 216 in the gusset 110 at a desired location about the panel 110. The pleat generator 318 is operated in a timed relation with the sewing machine 320.

The gusset forming station is the place on the gusset sewing system 300 where the gusset 110 is automatically formed before being sewn to the panel 106. Indeed, the gusset forming station is adapted to orient, process, feed, guide, and/or fold the gusset material to the panel 106 and sewing head. The gusset forming station can include a sewing machine 320 and a guide or positioning system to orientate the gusset material to the panel 106 prior to the gusset material being sewn by the sewing head of the sewing machine 320.

In one embodiment of the present invention, the gusset forming station includes a folding device 316 that guides and positions a continuous strip of gusset material relative to the panel 106 and to the sewing head to form a gusset 110. The gusset folder 316 allows the gusset 110 to be formed automatically (e.g., without operator interaction) before being sewn to the panel 106. The gusset forming station can further include a gusset guide that guides the gusset 110 fed to the sewing machine 320 toward a selected edge of the panel 106, so that the gusset 110 is held in substantial alignment with the edge of the panel 106. The gusset forming station can also comprise an accumulator 620 for accumulating a predetermined length of gusset material along a path, such that the predetermined length of gusset material is sufficient to attach around the perimeter of the panel 106. The accumulator 620 can include rollers 622 adapted to draw gusset material from a source or supply 312. When the gusset 110 is attached to a panel 106, the gusset 110, which may or may not be folded along the length of the material, is accordingly laid out over or proximate to the panel 106, and attached by a continuous or periodic stitch line through the two layers of materials. The gusset material is then positioned onto the panel 106 just prior to sewing at the guest forming station. Also, the gusset material is guided into a horizontal staging platform prior to sewing.

Figure 4:
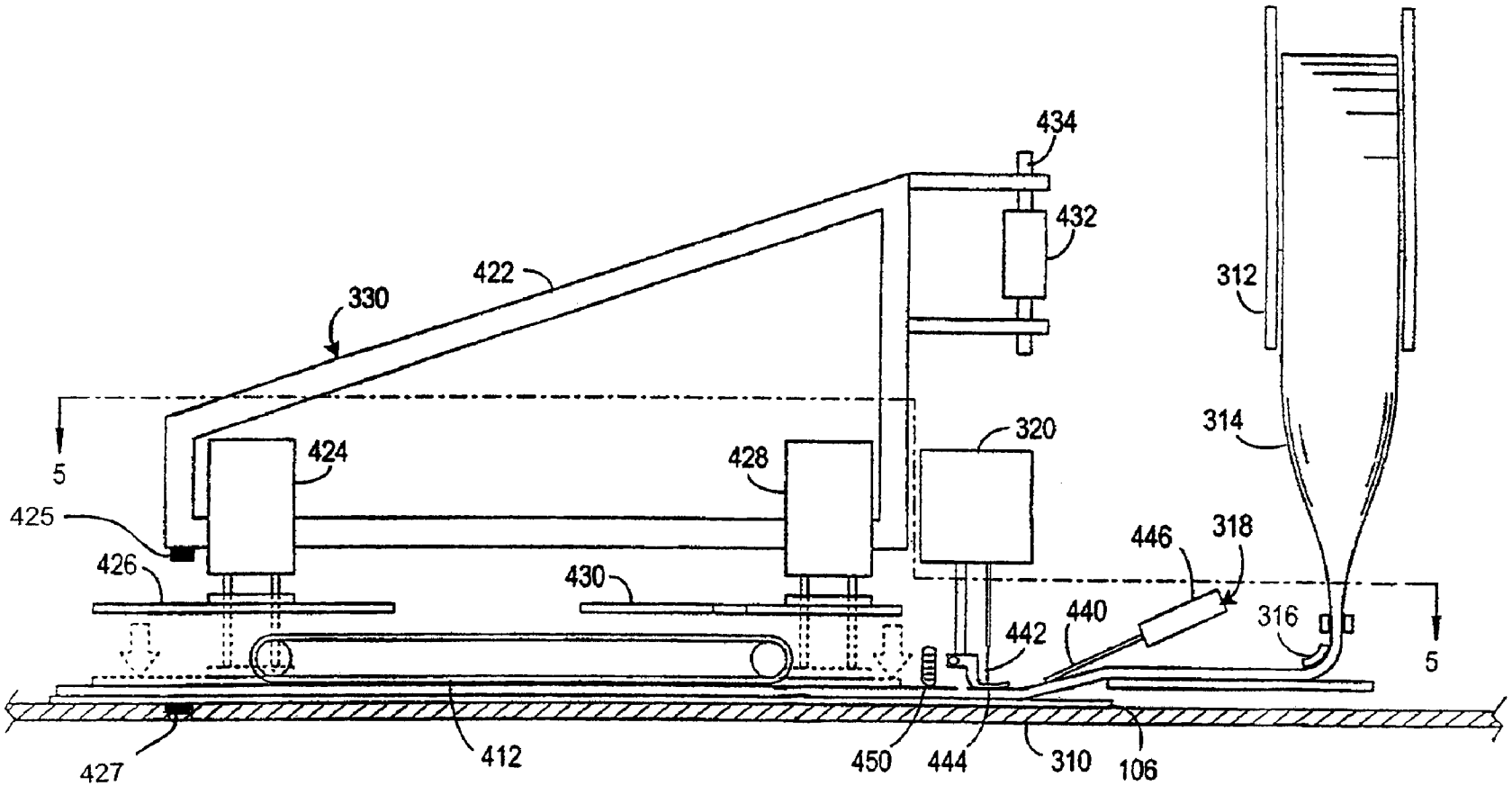
FIG. 4 is an elevational view of the gusset manufacturing machine shown in FIG. 3, as viewed from lines 4-4.

As shown in FIG. 4, the turning device 330 includes a frame 422, hingedly mounted to the sewing table 310, which supports a first pneumatic actuator 424 and a second pneumatic actuator 428. The frame 422 is affixed to a support 434 that is coupled to the table 310. A cornering actuator 432 is coupled to the frame 422 so as to be able to rotate the frame 422 between a first position and a second position. The first pneumatic actuator 424 is capable of raising and lowering a first clamp arm 426 and the second pneumatic actuator 428 is capable of raising and lower a second clamp arm 430. The first arm 426 and the second arm 430 work in concert to engage and turn the panel 106 at the corners of the panel. The clamp arms 426, 430 can be used for engaging and turning the panel 106 upon a detection of an edge approaching the sewing machine 320.

The cornering actuator 432 is adapted to move the clamp arms 426, 430 about an arcuate path to rotate the panel 106 with respect to the sewing machine 320. The clamp arms 426, 430 can have an angular configuration, whereby the clamp arms 426, 430 engage the panel 106 proximate to a corner 204 of the panel 106.

The turning device 330 further comprises an edge detector having a piece of reflective material 427 positioned at a predetermined location on the sewing table 310 and an optical sensor 425 that senses when the piece of reflective material 427 is uncovered (e.g., not covered by the panel 106). Accordingly, as the corner 204 of the panel 106 approaches, the panel 106 uncovers the reflective material 427 on the sewing table 310. The edge detector, therefore, can determine that a corner 204 of the panel 106 is approaching. After such determination, the turning device 330 can turn the panel 106 appropriately.

A material conveyor 412 moves the panel 106 along a linear path when the corners are not being 20 sewn. A guide wheel 450 keeps the panel 106 running along a substantially straight line during sewing. The guide wheel 450 is controlled by an optical sensor (not shown) that directs the edge of the panel 106 to a predetermined point when the edge of the panel 106 deviates from the predetermined point. The conveyor 412 engages the gusset 110 on the panel 106 and advances the gusset 110 and panel 106 together past the sewing machine 320 as the sewing machine 320 sews the gusset 110 to the panel 106. The material conveyor 412 comprises a rotationally driven belt that engages the gusset material in position upon the panel 106.

The sewing machine 320 includes a needle 442 and a sewing foot 444 (part of a sewing head) for holding the gusset material 314 against the panel 106. The ruffler 318 includes a plunger assembly 446 and a ruffler foot 440. The plunger assembly 446 is capable of driving the ruffler foot 440 back and forth to push rufflers (also referred to as pleats) into the gusset material 314, thereby forming pleats 216. The plunger assembly 446 (actuator 446) is controlled by, for example, the system controller, to coordinate with the sewing machine 320, such that the ruffler foot 440 is actuated independent of the belt drive. The pleat generator 318, therefore, is a separate device and operators independently from the sewing machine 320. The plunger assembly 446, in one embodiment, includes a pneumatic piston that is controlled so as to push the gusset material 314 into a ruffle when the needle 442 is in an "up" position and to retract the ruffler foot 440 when the needle is in a down position.

The sewing table 310 can comprise a surface, such as an upper surface, upon which the panel 106 can rest during the sewing process. The sewing table 310 can be formed to define a plurality of holes 340 or ports upon the surface of the sewing table 310. The sewing table 310 can further comprise at least one air chamber into which air is forced and from which air flows through the plurality of holes 340 upon the surface of the sewing table 310. The forced air assists in moving the panel 106 along the sewing table 310 during operation of the sewing machine 320.

The sewing table 310 can also comprise an air flow controller that controls airflow through the plurality of holes 340 of the sewing table 310. Accordingly, the flow controller controls airflow via the at least one air chamber so that air can flow substantially perpendicular to the sewing table 310. The air flow through the plurality of holes 340 of the sewing table 310 allows the panel 106 to ride on a cushion of air as the panel 106 is sewn to the gusset material by the sewing machine 320. The air flow controller is programmable so as to cause an increase in air flow as the panel 106 becomes heavier due to the gusset material being sewn thereto. Further, the air flow controller is programmable so as to increase air flow for more porous panel materials or heavier panel materials.

Figure 5A:
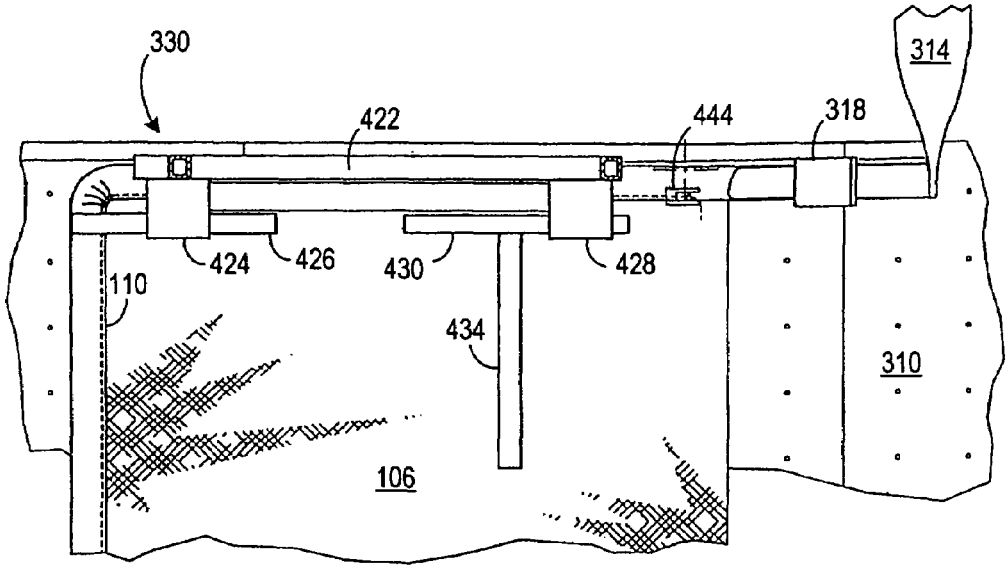
FIG. 5A is a top plan view of a portion of the gusset manufacturing machine shown in FIG. 4, as viewed from line 5-5, while in the process of sewing a gusset to a strait edge of a panel.
Figure 5B:
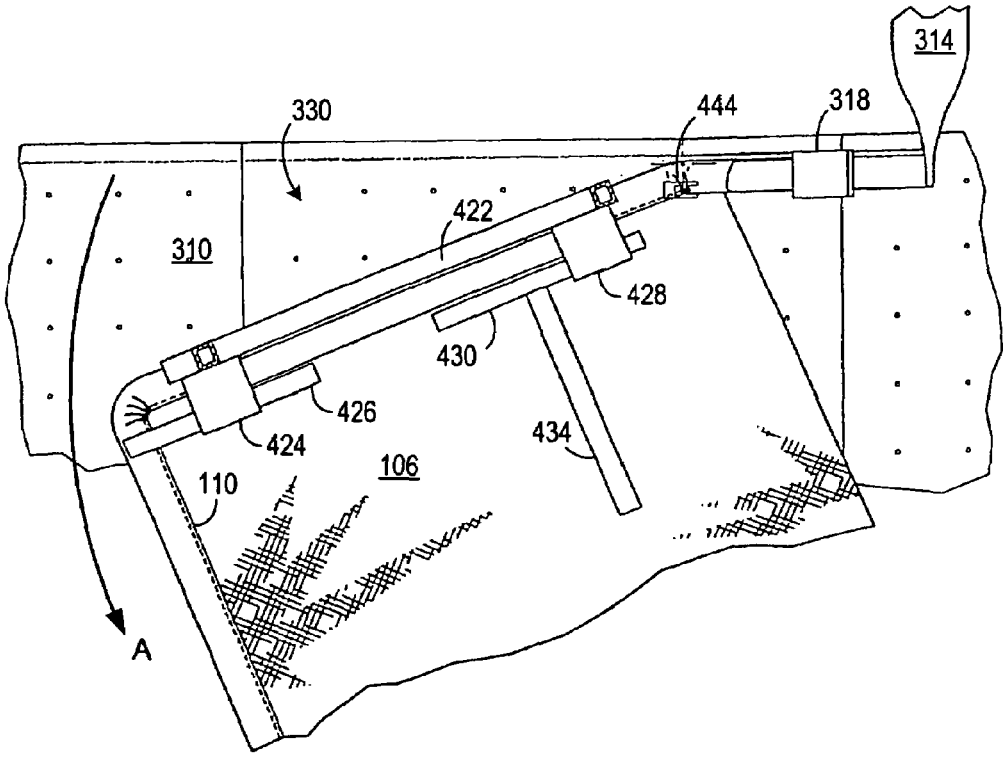
FIG. 5B is a top plan view of a portion of a gusset manufacturing machine shown in FIG. 4, as viewed from line 5-5, while in the process of sewing a gusset to a corner of a panel.

The turning device 330, as shown in FIGS. 5A and 5B, can include a transverse arm 434 extending from second arm 430. The transverse arm 434 helps to prevent the panel 106 from becoming bunched-up during a turn. Straight sewing is shown in FIG. 5A whereas the turning operation is shown in FIG. 5B. Essentially, the turning device 330 causes the arms 426, 430 and 434 to engage the panel 106 and the frame 422 is rotated in the direction of arrow A as the corner ruffling is sewn into the panel 106.

Figure 6:
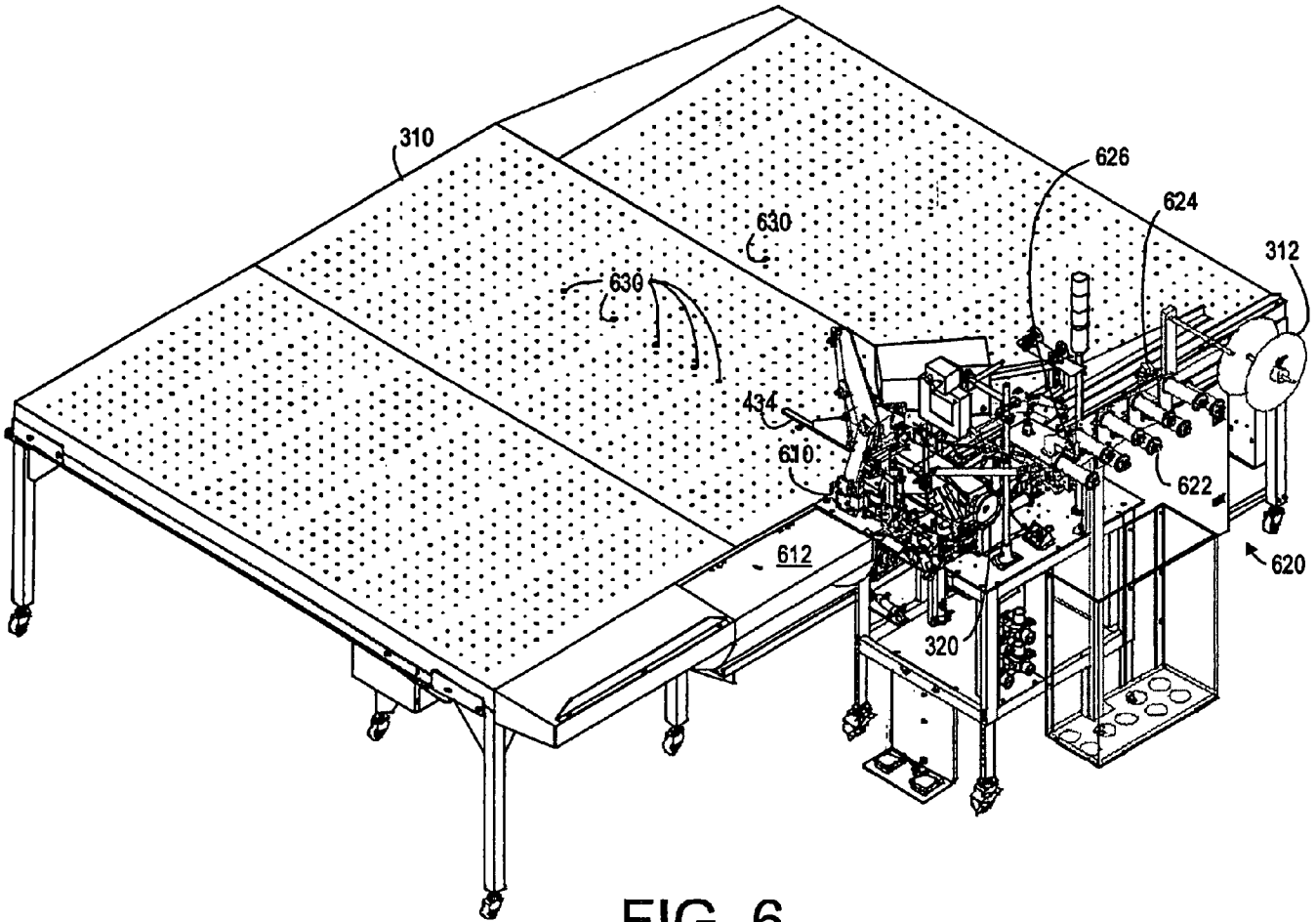
FIG. 6 is a top perspective view of a sewing table employing several aspects of the invention.

As shown in FIG. 6, the gusset sewing system 300 can include a movable gusset-cutting knife 610 that can extend outwardly from the sewing machine 320 at the termination of the gusset sewing process, thereby cutting the gusset material from the supply 312. The movable knife 610 includes an extended position and a retracted position, such that the movable knife 610 engages the gusset material in the extended position. Generally, the movable knife 610 cuts the gusset material after the gusset 110 has been sewn to the panel 106. For example, the movable knife 610 can cut the gusset material after a gusset 110 has been sewn completely around the perimeter of the panel 106. The knife 610 can include a pneumatically-drive blade adapted to cut the gusset material. To allow an operator to gain access to the sewing machine 320 while the knife 610 is in the retracted position, the sewing table 310 can further define a door opening. A trap door position 612 can be hingedly attached to the table 310 adjacent to the door opening. The trap door 612 may be driven by a pneumatic piston (or controllable actuator) and controlled so that the trap door 612 is in the "up" position during the automatic part of the sewing process and when the knife 610 is in the extended cutting position, thereby blocking the door opening. Accordingly, the operator cannot access the door opening via the trap door portion 612 when the movable knife 610 is in the extended position. The trap door 612 is driven to the "down" position when the operator needs to control the sewing machine 320 at the termination of the sewing process, after the gusset has been cut by the knife 610.

At least one controllable directional air jet 630 is included in the air table 310 to provide a directional jet of air when the panel is being moved so as to prevent bunching up of the panel. Alternatively, a plurality of controllable directional air jets 630 are aimed toward the direction of intended movement, which can include along the normal linear path taken by the panel and along the turning direction of the panel while the corners are being ruffled. Accordingly, the directional air jets 630 direct a force of air substantially parallel to the sewing table 310, so as to move the panel 106 in a predetermined direction (e.g., towards the sewing machine 320). Air flow to the directional air jets 630 can be controlled to provide more or less force on the panel, depending on the needs of the panel 106. Indeed, an air jet air flow controller is adapted to activate the plurality of directional air jets 630 when assistance is needed to move the panel 106 and to deactivate the plurality of directional air jets 630 when no assistance is needed to move the panel 106 along the sewing table 310. For example, heavier panel materials would require more force, as would more porous panel materials. Also, as a panel becomes heavier as a result of gusset material being sewn thereto, the airflow may be increased. Air flow control may be accomplished either by controlling the speed of the blowers that provide the air supply for the air table and the directional air jets or by opening or shutting louvers at the intake to the blowers. Indeed, the air flow can be variable by the system controller to accommodate variations in the size, weight, or material of the panel 106 being sewn.

Positioned near the gusset folder 316 is a mechanism adapted to ensure that enough gusset 110 material exists for a first purpose (e.g., enough material to cover the perimeter of the desired panel 110). An accumulator 620 may be included to ensure that sufficient gusset material is available to complete an entire panel. At the start of the sewing process, a clamp 626 holds the gusset material in a fixed position as the accumulator 620 pays out from the reel 312 onto a plurality of fifteen rollers 622 (two rows of which expanded away from each other) a length of gusset material required for a given panel. In other words, the accumulator 620 draws out the gusset material from a source 312 along a path having a predetermined length, such that the predetermined length is sufficient for the first purpose.

An optical sensor 624 detects whether the gusset material covers all of the rollers 622, the last one of which may be covered with a reflective material. The optical sensor 624 (or detector 625) is adapted to generate a signal that indicates when there is an insufficient amount of material in the accumulator 620 for the first purpose. Accordingly, the operator can be warned when there is not enough gusset material to engage the perimeter of the predetermined panel 106. More specifically, the path of the accumulator 620 has a first end adjacent the source 312 of gusset material and an opposite second end. The detector 624 generates the warning signal when there is no gusset material at the first end of the path. The optical sensor 624 further comprises a reflective material disposed adjacent the source 312 of the gusset material and is positioned as to be able to detect when the reflective material is not covered by the gusset material. Accordingly, the optical sensor 624 can determine if the gusset material is not at the first end of the accumulator 620. If insufficient gusset material exists for a panel, the operator can determine, by counting the number of rollers that are interleaved with the gusset material, if there is sufficient gusset material to edge a smaller-sized panel (e.g., a twin-size mattress panel, rather than a fill-size panel).

The accumulator 620 can comprise indicia that indicate when there is enough gusset material sufficient for a second purpose, different from the first purpose. The operator, therefore, can then determine if there is enough gusset material to be sewn on a smaller panel (e.g., the second purpose) or can then load more gusset material on the accumulator 620 to continue sewing on the predetermined panel 106 (e.g., the first purpose).

The accumulator 620 can also include a first plurality of rollers 622*a* that are evenly spaced apart, a second plurality of rollers 622*b* that are evenly spaced apart, and a mechanism that moves the second plurality of rollers 622*b* from a position to a second position. In the first position, the second plurality of rollers 622*b* is interleaved with the first plurality of rollers 622*a*, such that the gusset material is interleaved between the first plurality of rollers 622*a* and the second plurality of rollers 622*b*. In the second position, the second plurality of rollers 622*b* is spaced apart from the first plurality of rollers 622*a*. Accordingly, when the mechanism moves the second plurality of rollers 622*b* from a first position to a second position, a length of the gusset material is drawn from the supply 312 of gusset material (e.g., the source). A clamp 626 can be positioned adjacent to a selected roller of the first plurality of rollers 622*a*, such that the clamp 626 is capable of holding the gusset material against the selected roller while the second plurality of rollers 622*b* moves from the first position to the second position.

The gusset sewing system 300 further comprises a gusset tensioning device, such that the gusset tensioning device is capable of controlling the tension of the gusset 110 as the gusset 110 is being sewn to the panel 106. The gusset tensioning device can provide a desired range of tension on the gusset 110 as to create a particular characteristic of the gusset material. Characteristics of the gusset material include, but are not limited to, the ability of the gusset material to stretch and the ability to ensure that the direction of sewing of the gusset 110 is relative to the panel 106.

Figure 7:
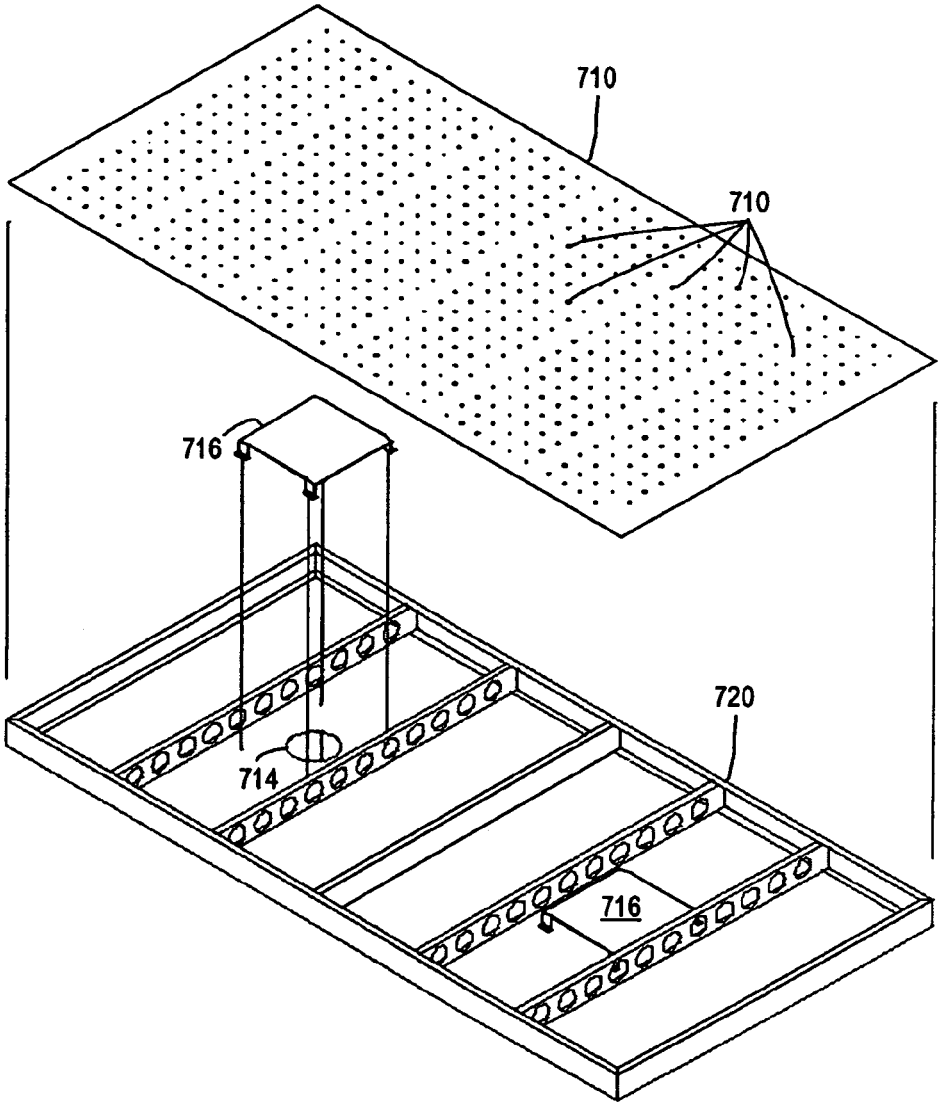
FIG. 7 is an exploded top perspective view of an air table employed in one embodiment of the invention.

An exploded view of a section 700 of an air table 310 is shown in FIG. 7. The section 700 includes a surface portion 710 that defines a plurality of openings 712 passing there through. The surface portion 710 is sealed to a manifold 720 that includes at least one passage 714 to an air supply (not shown), which could comprise one of many types of blowers generally available. A baffle 716 is disposed above the passage 714 to prevent local high concentrations of air flow through the surface portion 710.

Figure 8:
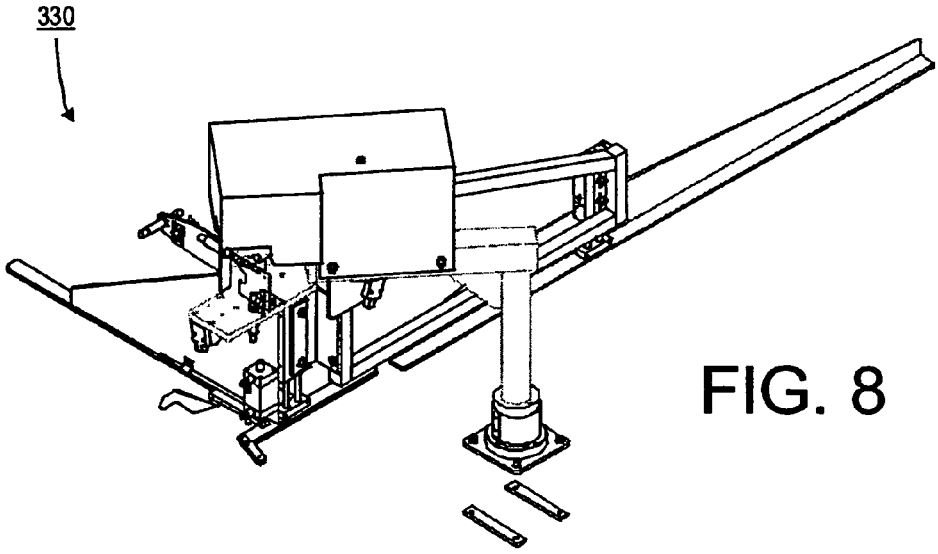
FIG. 8 is a top perspective view of a mechanism for rotating a panel about a corner, according to one aspect of the invention.
Figure 9:
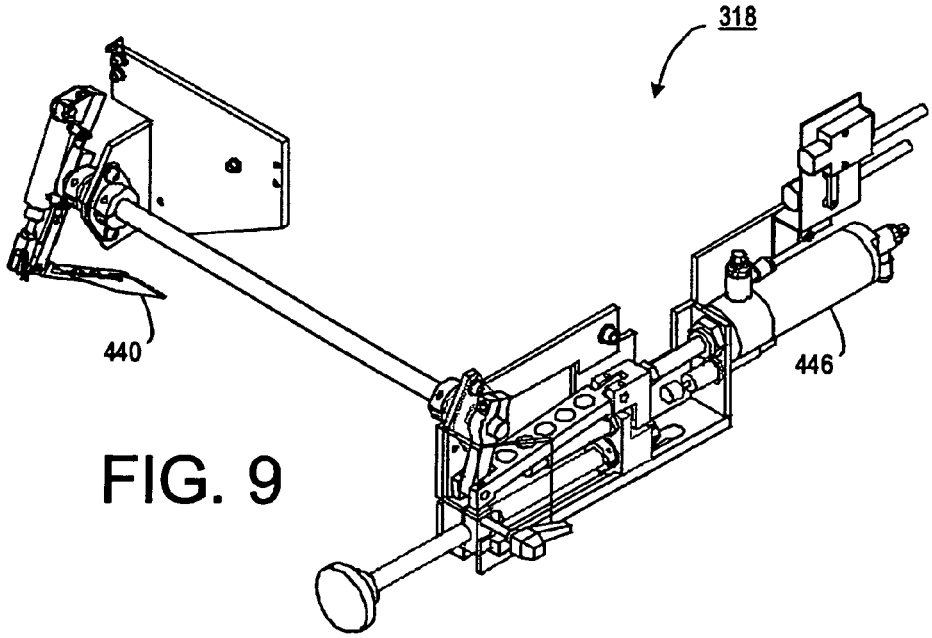
FIG. 9 is a top perspective view of a ruffler, according to one aspect of the invention.
Figure 10:
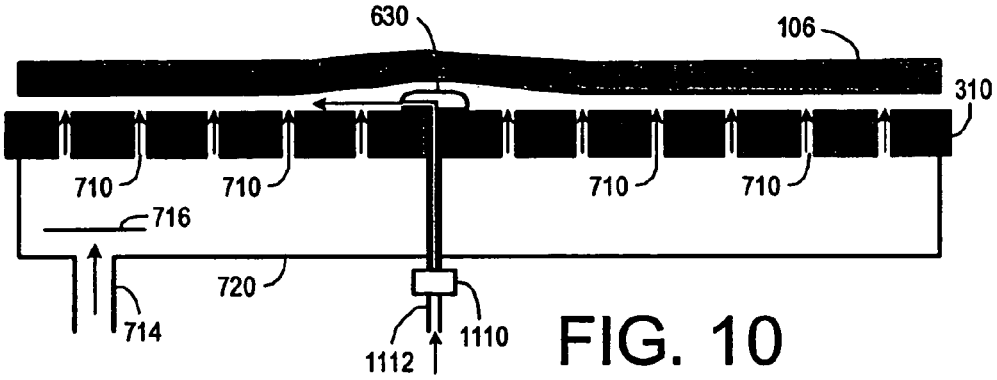
FIG. 10 is a side cross-sectional view of an air table employing directional air jets, according to one aspect of the invention.

The turning mechanism 330 is shown in greater detail in FIG. 8 and the ruffler 318 is shown in greater detail in FIG. 9. A detail of a directional air jet 630 and the air table 310 is shown in FIG. 10. The directional air jet 630 is supplied by an air supply 1112 and and controlled remotely by a solenoid 1110.

In operation, an embodiment of the present invention provides for automated production of ruffled gussets 110 of the type described herein. When the gusset 110 is attached to a panel 106, the gusset 110, which may or may not be folded along the length of the material, is accordingly laid out over or proximate to the panel 106, and attached by a continuous or periodic stitch line through the two layers of material. Where there is a curve or corner 204 in the panel 106 (or where there is to be a curve or corner in the gusset 110 independent of the configuration or perimeter of the panel 106—as in the case where a gusset 110 does not follow a perimeter of the panel 106), the panel 106 is turned relative to the point of attachment of the gusset 110 (i.e., the sewing needle 442) to alter the direction of the continuous band of gusset material. The pleats 216 are formed in one side of the gusset 110 as the panel 106 is turned relative to the present point of attachment, i.e., the sewing needle 442 or adhesive dispensing point. This is referred to generally as the "attachment point." Preferably, the pleats 216 are formed just prior to reaching the attachment point. The pleats 216 can be formed entirely by hand, or by use of a manual tool such as blade or paddle or any other suitable instrument, such as a flat strip or batten. Alternatively, the pleats 216 may be formed and held in place by tape or adhesive, and then run through a sewing machine 320 to install stitches. This can be done apart from or simultaneously with the turning of the panel 106. In certain applications, adhesive alone may be used to attach the gusset 110 to an adjacent piece of material.

Also, the gusset sewing system 300 can provide automated manufacture of the described attachment gusset. A spool (or supply reel 312) of gusset material is rotationally mounted above a folder 316 which includes bilateral guides and a centerline folding blade there between to place the gusset material in a folded state along a length of the material downstream of the folder 316. In this particular embodiment, the gusset material is folded in half along the length, although other folding arrangements could be utilized.

After folding, the gusset material is guided onto a horizontal staging platform, which is elevated slightly above a sewing table 310. In the cse of mattress manufacture, a panel 106 is positioned flat upon the sewing table 310 and under a foot 444 and sewing needle 442 of an automatic sewing machine 320. The folded gusset 110 is guided under the foot 444 and needle 442, and just prior to that under a pleating blade 440 (also referred to as a ruffler foot 440). The edge of the panel 106 is placed against a guide wall near an edge of the sewing table 310. The aligned edges of the gusset 110 are also guided against the guide wall, over the panel 106, and aligned with the panel edge also against the wall. A drive belt, mounted on drive rollers, maintains the gusset 110 and panel edges in alignment against the guide wall, and advances the panel 106 and gusset 110 through the sewing station, sliding over the sewing table 310. An additional material alignment device may be provided proximate to the guide wall, in the form of a bi-directional wheel which is driven as needed to maintain alignment of the material edge against the guide wall. The line of stitches 120 is made proximate to the fold in the gusset 110. However, the invention is not limited to this particular gusset 110 construction, and is readily applicable to sewn attachment at other areas across the width of the gusset material. Furthermore, the gusset 110 does not have to be in a folded condition when attached to an adjacent layer such as panel 106. As further described herein, the sewing table 310 is an air table 310 with plural air holes 340, 712 through which an air flow of appropriate volume and velocity is forced to facilitate sliding motion of the panel 106 over the surface of the table 310, as guided by the described machine components.

As a corner 204 of the panel 204 106 arrives at the sewing needle 442, clamps are lowered by actuators 424, 428 to compress the panel against the sewing table. The clamps are mounted upon hinge-mounted arms 426, 430, controlled by rotational actuator to rotate the hinge-mounted arms 426, 430 and the clamps, in this case ninety degrees, although other degrees or ranges of movement are within the scope of the invention. The panel 106 is thus turned ninety degrees relative to the guide wall and about the sewing needle 442. As this turning motion is taking place, the pleating blade 440 is actuated to create the radial series of pleats 216 along the inside edge or fold of the gusset 110. Preferably, the pleating blade 440 is actuated independent of the drive belt. This enables selective design of the ruffle pattern, e.g., number of pleats 216, relative to the rate at which the gusset material is drawn from the spool 312 and sewn to the panel 106. In practice, the drive belt is driven (by rollers) at a much higher rate as the gusset 110 is sewn along a straight line, as compared to the corners 204 at which the combined operations of the panel 106 turning and the ruffle formation (by extension and retraction of the pleating blade 440) are performed.

The control of the gusset sewing system 300 can be configured to operate according to known dimensions of the panel 106, or to calculate the panel 106 perimeter upon completion of the gusset 110 attachment. In one type of set-up, the panel 106 is positioned with a midpoint of one side at the sewing needles 442. The gusset 110 is sewn along the panel edge to the first corner 204, which is either optically detected or known from a pre-programmed dimension. The ruffler corner 204 is formed and sewn, and the gusset 110 is sewn along the next panel edge. When the panel edge opposite to the starting edge is reached, the distance of the first leg sewn is doubled to complete that side. The next corner is formed, and the gusset 110 sewn to the other opposite side. Following formation of the last ruffled corner, the gusset 110 is sewn to the midpoint starting position, after which the ends of the gusset 110 are sewn together.

To facilitate turning of the entire panel 106 without wrinkling by the rotational translation of the hinge mounted clamps, a constant flow of air is forced through holes 340, 712 in the sewing table 310. The pressure and velocity of the air flow is adjusted according to the porosity of the panel material. The air flow is preferably adjusted to an optimal pressure/velocity setting which minimizes sliding friction of the panel 106 upon the sewing table 310, so that the entire panel 106 is easily re-oriented through the ninety degree turns by the clamps as the gusset 110 is sewn about the perimeter. To control differential air pressure and flow rates cause by the panel 106 covering a substantial number of the holes 340, 712 of the sewing table 310, multiple plenums or chambers are preferably provided under the table 310 through which a compressed air supply is ducted. For example, the sewing table 310 can be divided into three chambers, which are each supplied with a compressed or pressurized air supply. By this arrangement, in that state where the panel 106 is covering substantially all of the holes 340, 712 of a chamber, the air pressure in the adjacent chambers is not affected, and therefore does not disrupt the sewing operation.

Figure 11:
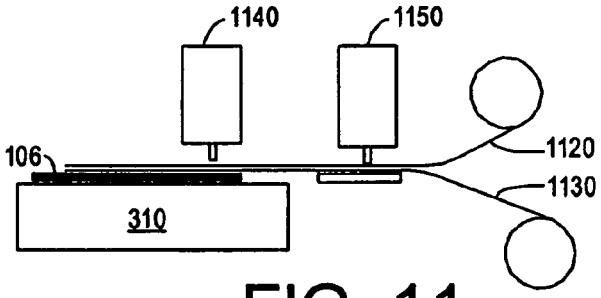
FIG. 11 is a side elevational view of an apparatus for sewing both a gusset and a flange to a panel, according to one aspect of the invention.

In one embodiment, as shown in FIG. 11, the gusset material 1120 and the flange material 1130 may be sewn to the panel 106 in a single operation. In this configuration, the gusset sewing system comprises a gusset material supply, a flange material supply, a folding device 316 that folds the gusset material 1120, a first sewing machine 1150 for sewing gusset material 1120 to the flange material 1130, and a second sewing machine 1140 for sewing the produced gusset-flange material to a mattress panel 106. The first sewing machine 1150 is adapted to receive the gusset material 1120 from the folding device 316 and the flange material 1130, such that the first sewing machine 1150 sews the gusset material 1120 to the flange material 1130, thereby forming a gusset-flange. The second sewing machine 1140 is adapted to receive the gusset-flange from the first sewing machine 1150 and sew the gusset-flange to the mattress panel 106.

The system can further comprise a pleat formation blade 440 having a first position and a second position, an actuator (e.g., a plunger assembly 446), a sewing machine state sensor, and a ruffler 318 (also referred to as a pleat generator 318). The pleat formation blade 440 can be moved between a first, non-engaging position and a second position engaging the gusset 110, so that a pleat 216 is formed in the gusset 110 as the gusset 110 is sewn to the panel 106. The actuator 446 is adapted to selectively move the pleat formation blade 440 between the first position and the second position. The sewing machine state sensor is adapted to generate a signal indicative of a position of a sewing needle 442 of the sewing machine 1140, such as a raised position and a lowered position of the sewing needle 442. The ruffler controller is adapted to activate the actuator 446 to move the pleat formation blade 440 from the first position to the second position, when the sewing machine state sensor indicates the sewing needle 442 is moving toward a raised position.

A material conveyor 412 adjacent the second sewing station is included, such that the material conveyor 412 is adapted to engage the gusset 110 on the panel 106 and advance the gusset 110 and panel 106 along a sewing path as the gusset 110 is sewn to the panel 106.

A sewing table 310 utilized by the gusset sewing system can have a table surface upon which the panel 106 is received and supported. The table surface can be formed to define a plurality of holes 340 therein, such that an air flow can be passed through to assist the movement of the panel 106 along the table surface.

A system controller is included that controls the sewing of the gusset 110 to the panel 106. The system controller causes the second sewing machine 1140 to operate at a first rate for sewing the gusset 110 to the panel 106 when the pleat generator 318 is not operating (e.g., the pleat forming blade 440 is in the first position) and causes the second sewing machine 1140 to operate at a second rate when the pleat generator 318 is engaged to form a pleat 216 in the gusset 110 (e.g., the pleat forming blade 440 is in the second position). Generally, the rate for sewing the gusset 110 is faster when the pleat generator 318 is not operating, than when the pleat generator 318 is operating.

To facilitate the use of gusset material 1120, the system further comprises an accumulator 620 and a detector 624. The accumulator 620 draws the gusset material 1120 form a source along a feed path, so as to accumulate a predetermined length of the gusset material sufficient to form a completed gusset panel upon sewing to the panel 106. The detector 624 is generally mounted along the feed path in a position to detect the accumulation of gusset material 1120. The detector 624 is adapted to generate a signal indicating that there is insufficient gusset material 1120 in the accumulator 620.

The accumulator 620 comprises a first plurality of rollers 622*a*, a second plurality of rollers 622*b*, and a drive mechanism. The first plurality of rollers 622*a* is mounted in spaced series and is adapted to receive the gusset material as it is passed from the gusset material supply 312. The gusset material 1120 can also pas through the second plurality of rollers 622*b*. The second plurality of rollers 622*b* is adapted to move between a rest position adjacent the first plurality of rollers 622*a* and a second position spaced from the first plurality of rollers 622*a*. The drive mechanism moves the second plurality of rollers 622*b* from the rest position toward the second position, thereby drawing gusset material 1120 from the gusset material source 312.

Figure 12:
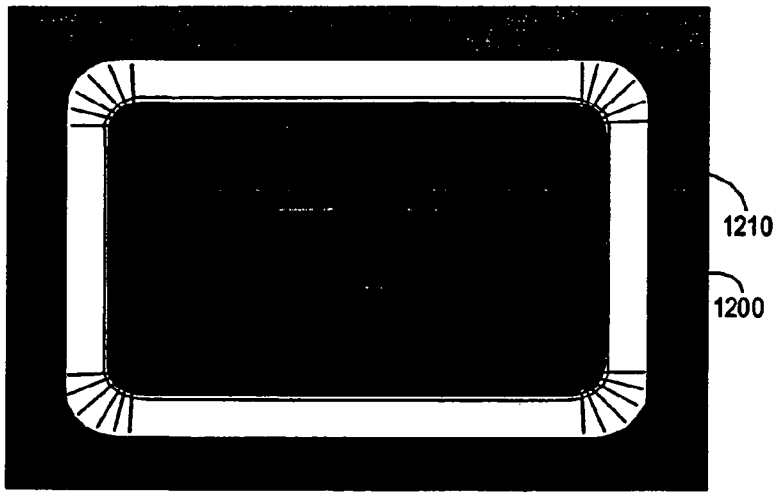
FIG. 12 is a top plan view of a panel with a recessed gusset, according to one aspect of the invention.

In one embodiment of a panel/gusset combination, as shown in FIG. 12, the gusset 1219 may be sewn to the panel 1200 so as to leave a predetermined width of panel 1200 extending away from the gusset 1210. In this embodiment, the extra panel material eliminates the need for a flange, as the periphery of the panel 1200 is attached directly to the side wall of the mattress body.

In still another embodiment of the present invention, the gusset sewing system 300 can be used to attach a gusset material to a work piece. In such a configuration, the gusset sewing system 300 includes an accumulator 620, a folder 316, a sewing machine 320, a clamp arm 426, and a system controller. The accumulator 620 is adapted from drawing a predetermined length of gusset material from a supply 312. The folder 316 is generally positioned adjacent the accumulator 620, such that the folder 316 receives the gusset material from the accumulator 620 and forms the gusset material into a desired gusset configuration. The sewing machine 320 can be positioned along a sewing path for the work piece. Accordingly, the sewing machine 320 attaches the folded gusset material to a peripheral portion of the work piece. The clamp arm 426 is movable to engage with the work piece as a corner 204 of the work piece approaches the sewing machine 320. After a corner 204 of the work piece is detected, the clamp arm 426 turns the work piece with respect to the sewing machine 320. The system controllers is adapted to monitor and control the sewing of the gusset material to the work piece at varying rates and to control the turning of the work piece by the clamp arm 426.

Method of Attaching a Gusset to a Panel

The gusset material can be sewn to a mattress panel 106 according to a predetermined method. First, the gusset material is sewn, such as with a sewing machine 320, to the panel 106 along a first substantially path. Next, a corner 204 of the panel 106 is detected, such as by the edge detector. The panel 106 is then turned by the turning mechanism 330 when the corner 204 of the panel 106 approaches the sewing machine 320, so that the gusset 110 follows a curved path adjacent the corner 204 of the panel 106. After the gusset 110 has been sewn around the corner of the panel 106, the gusset 110 is sewn to the panel 106 along a second substantially linear path which is angularly divergent from the first substantially linear path.

The method can further comprise the creating of at least one pleat 216 in the gusset 110 at a region that is adjacent to the corner 204 of the panel 106. After a pleat 216 is created, the pleat 216 is sewn into the panel 106 by the sewing machine 320. To create the at least one pleat 216 in the gusset 110, the sewing machine state sensor can detect movement of a needle 442 of the sewing machine 320 toward a raised position. Then, the gusset 110 can be engaged with a pleat formation blade 440 as the needle 442 is in the raised position, thereby forming a pleat 216 in the gusset 110. The pleat formation blade 440 is then moved away from engagement with the gusset 110 as the needle 442 is moved downwardly to engage the pleat 216.

The step of sewing the gusset 110 to the panel 106 can comprise sewing at a first desired rate of sewing and then varying the rate of sewing as the panel is turned by the turning mechanism 330. The rate of sewing the gusset 110 to the panel 106 can be reduced as the at least one pleat 216 is formed in the gusset 110.

The method can further comprise the step of accumulating a predetermined length of the gusset material sufficient to form a gusseted panel of a desired size. As described above, the accumulator 620, first plurality of rollers 622*a*, second plurality of rollers 622*b*, and detector 624 can be used to accumulate a predetermined amount of gusset material, while also determining whether there is enough gusset material for attachment to the panel 106 of a desired size.

Operator Interaction with the Gusset Sewing System

The gusset sewing system 300 can comprise a touch-screen adapted to allow the operator to configure the gusset sewing system 300 for the manufacturing of gussets 110 of varying styles. More particularly, the touch-screen allows an operator to program certain aspects of the system controller, which will control various components of the gusset sewing system. Initially, the touch-screen displays operational information and multiple graphical images presents as "3-dimensional buttons," which may be pressed by the operator to access other screens, change counters and timers, or actuate hardware of the gusset sewing system 300. The counters may be adjusted by pressing the "+" box (e.g., incrementing button) and the "−" box (e.g., decrementing button). If the operator presses a dark area of the counter button, another screen will be accessed which gives detailed information about the particular counter and how to adjust it. Pressing the RESET button from any screen clears all system function and returns to the READY page.

Normal operation of the gusset sewing system 300 can be controlled from the READY page. From the READY page, the operator can START the auto cycle and access the SETUP, MANUAL, PIECE COUNT, and STYLE pages. Additionally, the READY page permits activation of the THREAD PULL-OFF and the ACCUMULATOR 620. The READY page allows the operator to access the necessary functions and adjustments needed for normal operation of the gusset sewing system 300.

There are also advanced functions that are only accessible by an authorized mechanic and include: timers and counters that control machine hardware, input and output test screens, and machine statistics. To get to the advanced functions the appropriate password must be entered at the security screen. Security access is reset whenever the main power is turned off, or the RESET button on the READY page is pressed.

The gusset sewing system 300 includes "light tower" functions to provide the operator with a visual indication of the current status of the gusset sewing system 300. The light tower functions provide a status indication that can be seen at a considerable distance from the gusset sewing system 300. The light tower provides different light states representing different operational states of the gusset sewing system 300. An example of varying light states is provided in Table 1.

TABLE 1

| Light Status | Definition |
|---|---|
| Green Steady | Machine is making a panel |
| Green Flashing | Machine is sewing the last side of the panel and will finish soon |
| Yellow Steady | Machine is on but idling between panels |
| Yellow Flashing | Machine is stopped in the middle of a panel and needs operator attention before continuing. Possibly the machine has stopped because of an error, thread break, etc. If the operator cannot recover, the mechanic must be called. |
| Red | Available for future use, not currently utilized |

The gusset sewing system 300 includes several basic manual operations to be performed by the operator during use. A first basic manual operation includes loading the gusset roll 312 and accumulator 620. For the first basic manual operation, the operator loads the roll of gusset material on to a roll holder between the two discs, so that when the gusset material is fed toward the accumulator 620, wherein the good side of the gusset material is facing up. Next, the operator ensures that a drag tension tap is draped over the top of the roll and that the discs are snug against the roll core. The operator then feeds the gusset 110 straight between the movable rollers (second plurality of rollers 622*b*) and stationary rollers (first plurality of rollers 622*a*) toward the right angle guide. Next, the operator feeds the gusset 110 around the right angle guide and over to the upper fold guide.

A second basic manual operation includes loading and adjusting the gusset folders 316 (which can be part of the gusset forming station). The operator begins by feeding the gusset 110 under a right upper guide rod and over a left upper guide rod and then down toward the folder 316. Next, the operator opens the ends of both folders 316 for easier loading. The operator then feeds the gusset material through the first folder 316*a*, around a tension plate, and through the second folder 316*b*. The operator can ensure that the folder tongues are inside the folded gusset 110. Next, the operator closes the folders 316 and loosens the folder lock screws. The operator can then slide the folders 316 left or right as needed to make a close fit on the folded gusset 110. After tightening the lock screws, the operator can pull the gusset material through the second folder 316*b* toward the sewing head until the end of the gusset material is about two inches beyond the end of a stripper blade. Generally, it is necessary to have about one and one-half inches of unsewn gusset 110 at the start of the panel 106 for finishing the overlap. The operator then lowers the folder assembly and pushes the folder assembly all the way in, toward the gusset sewing system 300, so that the gusset 110 is under the pressure foot and the folder 316 is in as far as it will go. The gusset sewing system 300 is designed not to operate in the automatic cycle, if the folder assembly is not in all the way. If the presser foot is not up, the operator presses the LOAD PANEL button or RESET button on the touch-screen.

A third basic manual operation includes adjusting an active edge guide. The active edge guide, located under the cloth plate, controls the position of the panel 106 while sewing. The position of the panel 106, left to right, is determined by the electric eye (e.g., edge detector) that looks up through a hole in the cloth plate at the reflective tape on the bottom of the folder 316. The electric eye is positioned by turning a small plastic knob to the right of the electric eye. Turning the knob clockwise moves the electric eye and the panel position to the right. The operator adjusts the electric eye as necessary to align the edge of the panel 106 to the edge of the gusset 110.

Next, the operator sets the alignment guide 450 to match the position of the edge guide to aid in loading the panel 106.

A fourth basic manual operation includes starting the automatic cycle of the gusset sewing system 300. With the gusset 110 loaded and the folder assembly all the way in, the operator position the panel 106 under a presser foot, which is located in the middle of a short side and aligned with the alignment guide 450. If this panel 106 is the last one to be sewn with the current gusset roll 312, the operator starts the automatic cycle by pressing the START SINGLE button of the touch-screen. If the next panel 106 will use the same gusset roll 312, the operator starts the cycle with the START MULTIPLE button of the touch-screen. When the operator starts with the START MULTIPLE button, the accumulator 620 will activate at the end of the cycle (while the operator is unloading the finished panel 106 and getting the next panel 106 ready) so that by the time the operator is ready to start the next panel 106 the accumulator 620 will be finished measuring gusset material for the next cycle. After the operator presses the START button, the automatic cycle will begin. The presser foot will drop and sewing will begin. At the same time the trap door 612 will rise and fill in the opening in front of the sewing head. The operator must step aside to allow the trap door 612 to move. The operator will be sure to keep hands, clothing, and other body parts clear of the trap door 612 while it is moving. The sewing machine 320 will sew all four sides of the panel 106, ruffling the corners, stop at the over-sew, cut the gusset 110, and position the folder 316 out of the way for closing the gusset 110 and finishing the panel 106.

A fifth basic manual operation includes making adjustments to the settings of the gusset sewing system 300. Before starting a panel 106, the operator ensures that the correct STYLE has been selected. The STYLE sets up all the counters and timers and other settings that control the sewing operation. The parameters of the selected STYLE, therefore, set up the air jets 630 for turning the different size panels 106 and set up the correct gusset tension and blower setting for the type of panel 106 being sewn (e.g., either MNO (quilted) or PLAIN). To change the STYLE, the operator presses the STYLE button, which will cause the SELECT STYLE MENU 1 page to appear. By pressing the arrow button at the top of the page, the operator can reach the SELECT STYLE MENU 2 page for more style settings. The operator then selects the desired style, which will cause the STYLE page to appear. By pressing the RECALL SETTINGS button, the touch-screen display will return to the READY page.

Pressing the MANUAL button displays the MANUAL page. At the MANUAL page, the operator can temporarily change the blower speed setting, turn the blower on and off, cycle the knife 610, turn on the ruffler 318, disable the knife 610, and turn on the individual tension regulators to make adjustments to the gusset tension settings.

Pressing the SETUP button displays the SETUP page. At the SETUP page, the operator can access system information about the gusset sewing system 309, change security codes, display statistics, show all settings on one screen, adjust touch-screen contrast, run the gusset sewing system 300 in step-by-step mode, and temporarily change the air jets 630 for the first and second sides of the panel 106.

Pressing the ADVANCE SETUP button or the arrow button at the top of the SETUP page displays the security page for inputting the mechanic's access code. Once this code has been entered, the operator can access the ADVANCED SETUP pages and adjust other settings of the gusset sewing system 300. The access code remains active until the RESET button from the READY page is pressed or power is disconnected. Changing the access code to "00000" will disable the security function and allow full access to all settings.

A sixth basic manual operation includes finishing the panel 106 after the gusset sewing system 300 has paused, after sewing the gusset 110 to the panel 106. After the gusset sewing system 300 has finished sewing the gusset 110 to the panel 106, the operator can fold the trailing edge of the gusset 110 back about ¾ inches and tuck the trailing edge into the starting edge fold. The operator then steps on the right SEW pedal to run the sewing machine 320 at a medium speed until the desired over-sew is achieved. The operator then taps the left FOOT LIFT pedal causing the thread pull-offs to activate and the presser foot to lift. Generally, the FOOT LIFT pedal will not function until the SEW pedal has been used. The operator can then remove the panel 106 to the left and trim the threads on the cutter provided. If the gusset sewing system 300 was started in the START MULTIPLE mode, the accumulator 620 will cycle and will have additional gusset material ready for the next panel 106.

A seventh basic manual operation includes adjusting the corner ruffles 216. When the gusset sewing system 300 turns a corner 204 the number of stitches that will be sewn in the corner 204 is controlled solely by the speed of the turning clamps, because turning stop s as soon as the OUT limits switch is reached. The speed of the turning clamps is set with the Thumbwheels on the middle stepper control box. This speed should be adjusted so that the number of stitches in the corner 204 is equal to or greater than the number of ruffles 216 that will be set in the corner 204. The number of ruffles 216 is set using a counter during initial setup. Table 2 below describes the correct settings of the stepper box for the desired number of stitches in the corner 204. The operator can sew more stitches than ruffles 216, but not more ruffles 216 than stitches because ruffling also stops when the OUT limit switch is reached.

TABLE 2

| Stepper Thumbwheel | Number of Stitches in Corner |
|---|---|
| 900 | 5 |
| 800 | 6 |
| 700 | 7 |
| 600 | 8 |
| 500 | 9 |

The ruffle size is determined by the stroke of the ruffler blade 440 (e.g., the pleating blade 440) from the OUT position (first position) to the IN position (second position). The IN position is set to control the location where the needle 442 pierces the ruffle and is adjusted to pierce in the middle of the fold. The width of the ruffle is controlled by the OUT position and is adjusted with a round knob near the handwheel. The operator can adjust the ruffle size so that the outer edge of the corner radius layer flat.

The touch-screen further comprises settings menus having three ADVANCED SETUP pages. The ADVANCED SETUP pages are accessed through the SETUP button and the ADVANCED SETUP button or the arrow button on the SETUP page. The operator must provide a mechanics security code in the security page for these settings to be available. Table 3 describes an exemplary list of settings available in the ADVANCE SETUP pages, as well as the detailed functionality of the settings.

TABLE 3

| Setting | Description |
|---|---|
| Blower | Controls the speed of the air table blower motor. A setting of 0 is off, 1 is the lowest speed, and 7 is the highest speed. This does the same thing as the blower control buttons on the MANUAL page. |
| Knife On Time | The on time of the knife chop solenoid in 1/100ths seconds. Adjust so that the knife blade makes a full stroke and a complete cut of the gusset. |
| Thd Pull Off Time | The on time of the Thread Pull-off solenoid is 1/100ths seconds. Adjust so that the Thread Pull-off cylinders make a full stroke. |
| Ruffles/Corner | The number of ruffles that will be made in each corner. When the rotator reaches the Out Limit Switch any remaining ruffles will be ignored. Adjust the number of ruffles along with the speed of the turning so that all required ruffles are completed in the turn. |
| End Sew Gap | The number of stitches used by the control to stop the sewing if the gusset End Detector Sensor misses the end of the gusset on the last side of the panel. Acts as a safety device to keep the machine from "running away." If this counter is set to "0" the safety feature is disabled. |
| Corner Stop Cnt | A stitch count used to adjust the stopping position of the panel at the corners. Adjust so that the panel stops approximately 3" from the needle. When this counter is set correctly, the edge of the panel will line up with the right edge guide plate at the end of the corner ruffle. This is the primary counter used to set the corner stopping position. |
| Low Speed Stop Cnt | This is a stitch count at positioning speed to control the stopping of the sewing head. It is adjusted so that there is one slow stitch as the sewing machine stops sewing in the corners. This count is proportional to sewing speed. |
| Conveyor Down Delay | The time from the Sew Jam Eye seeing the leading edge of the panel until the Conveyor drops. Adjust so that the ruffled corner is completely under the conveyor before it drops. This time is in 1/100ths seconds. |
| Edge Guide Jam Delay | The amount of time the Edge Guide Eye can remain in one state (light or dark) before a jam error will occur. This time is in 1/100ths seconds. |
| Looper Thd Det. Delay | The time from the sewing head starting in high speed until the looper thread detector becomes active. Adjust to allow the head to reach full speed before the thread detector becomes active. This time is in 1/100ths seconds. If this time is too short, false thread breaks will occur at start-up. |
| Needle Thd Det Delay | The time from the sewing head starting in high speed until the needle thread detector becomes active. Adjust to allow the head to reach full speed before the thread detector becomes active. This time is in 1/100ths seconds. If the time is too short, false thread breaks will occur at start-up. |
| Finger Clamp Up Delay | The time from the Finger Clamp solenoid turning off until the Clamps Up solenoid turns off. This allows time for the Finger Clamp to get out from under the folder before it and the clamps rise. This time is in 1/100ths seconds. |

TABLE 3-continued

| Setting | Description |
|---|---|
| Sew Head Jam Det Dlv | The time from the start of sewing until the Sew Jam Det. Eye should be covered. If the eye is not covered in this time a jam error will occur. This time is in 1/10 ths seconds. |
| Cut Cycle Enable | Set this counter to "0" to turn off the gusset knife. This setting is mainly used for testing purposes. Normally set to "1." This does the same thing as the Cut Cycle On/Off button on the MANUAL page. |
| Panel Material Tension | This counter is used to select the gusset tension regulators for MNQ panels (0) or PLAIN panels (1). |
| Accumulator Jam Time | The time allowed for the accumulator rollers to move to the bottom of their stroke. If the rollers do not reach the down sensor in this amount of time an error will occur. This time is in 1/10 ths seconds. |
| End Sew Stop Delay | The number of stitches sewn after the gusset End Detector sees the starting end of the gusset and sewing stops. Use this counter to adjust the amount of overlap of the gusset material needed for closing. Setting this counter to "0" disables the End Detector and causes the sewing machine to stop based on the End Sew Gap setting. |
| Soffie Jets First Side | Controls whether the Soffie Jets are blowing on the first side of the panel. "1" = on, "0" = off. This setting is usually set to "0" for Twin and Full Panels and "1" for Oueen and King. |
| Soffie Jets Second Side | Controls whether the Soffie Jets are blowing on the second side of the panel. "1" = on, "0" = off. This setting is usually set to "0" for Twin and Full panels and "1" for Queen and King. |

The described settings of the gusset sewing system 300 can be saved as a STYLE and recalled later for reuse. An existing STYLE can also be recalled, edited, and copied.

To create a new style via the touch-screen, the operator presses the STYLE button displayed in the READY page. Next, the operator selects an unused style to edit in the SELECT STYLE MENU 1 or 2. Then, in the STYLE page, the operator presses the EDIT NAME selection. In the STYLE NAME EDIT menu, the operator can use the Cursor Left and Cursor Right buttons to position the cursor over the first character to change. The operator uses the Letter Forward and Letter Back buttons to change the character as desired. The operator continues to move the cursor and enter or change characters until the desired "Name" is entered. Available characters include A-Z, 0-9, /, ., -, and Blank. The operator can use the "Blank" character to erase unwanted characters. Next, the operator presses EXIT. In the STYLE menu, the operator presses SAVE SETTINGS and then EXIT to complete the creation of a new style.

To recall a style, the operator presses the STYLE button from the READY page on the touch-screen. Next, the operator selects the desired style to recall from the SELECT STYLE MENU 1 or 2. In the STYLE page, the operator then presses the RECALL SETTINGS button. If the WARNING page displays, the operator presses RECALL SETTINGS again and then presses EXIT.

To edit an existing style, the operator presses, the STYLE button from the READY page on the touch-screen. Next, the operator selects the desired style to edit from the SELECT STYLE MENU 1 or 2. In the STYLE page, the operator presses the RECALL SETTINGS button. If the WARNING page displays, the operator presses RECALL SETTINGS again and then presses EXIT.

To edit the settings of the gusset sewing system 300 as desired, the operator presses the STYLE button from the READY page on the touch-screen. Next, the operator selects the currently used style from the SELECT STYLE MENU 1 or 2. In the STYLE page, the operator presses the SAVE SETTINGS button and then presses EXIT.

To copy an existing style, the operator presses the STYLE button from the READY page on the touch-screen. Next, the operator selects the desired style to copy from the SELECT STYLE MENU 1 or 2. In the STYLE page, the operator presses the RECALL SETTINGS button. If the WARNING page displays, the operator presses RECALL SETTINGS again and then presses EXIT. Next, the operator presses the STYLE button from the READY page on the touch-screen. Then, the operator selects the desired style to copy to from the SELECT STYLE MENU 1 or 2. In the STYLE page, the operator presses the SAVE SETTINGS button and then presses EXIT.

The operator can also make general adjustments to ensure that the gusset sewing system 300 works properly. The general adjustments include, but are not limited to, setting air supply pressure regulators, setting gusset tension pressure regulators, setting the lower air pressure switch, setting the stepper control box thumbwheels and jog speeds programming the blower speed control, setting the air jets 630 in the sewing table 310, programming the sewing machine 320, setting the ruffler drive assembly, setting the fold assembly, setting the edge guide assembly, setting the rotator assembly, setting the puller assembly, setting the knife assembly, setting the rear conveyor assembly, setting the accumulator assembly, and performing regular maintenance to the gusset sewing system 300.

The operator can also set the air supply pressure regulators. Table 4 describes exemplary settings for the air supply pressure regulators.

TABLE 4

| | |
|---|---|
| Main | 80 PSI |
| Sewing Blowers | 40 PSI |
| Turning Blowers | 40 PSI |
| Turning Clamps | 10 PSI |
| Edge Guide | 30 PSI |

The operator can additionally set the gusset tension pressure regulators. Table 5 describes exemplary settings for the gusset tension pressure regulators. The operator can turn on the regulators from the MANUAL page of the touch-screen display.

TABLE 5

| | |
|---|---|
| MNQ Short Side | 5 PSI |
| MNQ Long Side | 7 PSI |
| Plain Short Side | 2 PSI |
| Plain Long Side | 3 PSI |

The operator can set the low air pressure switch to trip at a designated PSI (pounds per square inch). For example, the operator can set the low air pressure switch to trip at 60 PSI.

Further, the operator can set the thumbwheels of the stepper control box and the jog speeds. For example, the operator can set the top box (puller) to "420" on the thumbwheels, the middle box (rotator) to "85" on the thumbwheels, the middle box (rotator) jog knob to "54" on the dial, the bottom box (conveyor) to "420" on the thumbwheels, and the bottom box (edge guide) jog knob to 80 RPM at the edge guide wheel (by removing a cover for access).

The operator can set the directional jets 630 in the air table 410 so that they blow in predetermined directions. Moreover, the operator sets the flow controls on the jets 630 to be all the way open. All of the flow controls can be set by the operator to ensure smooth, quiet motions of all of the cylinders, wherein all of the cylinder limit switches are set at the ends of the strokes.

The operator can set the sewing machine head assembly and sewing motor parameters. Table 6 describes the various sewing motor parameters that can be used by the operator.

TABLE 6

| Mode | 106-Y2 |
|---|---|
| Positioning Speed | 132-1000 RPM |
| High Speed | 135-3500 RPM |
| Foot Lift Modulation | 605-64 |
| Foot Lift Modulation | 606-1 |

In order to set the sewing machine head assembly, sewing motor parameters, and other aspects of the sewing machine 320, the operator can set the rotation direction of the sewing machine 320, set the sewing stitch length (generally 8 stitches per inch), and set the needle up position to be twenty degrees before top dead center. The operator can set the needle up position by rotating the outside tape collar at the handwheel. The needle up position is where the needle 442 will be when the ruffler blade (e.g., pleating blade 440) starts its IN stroke (e.g., moves to the second position). This is related to the needle's 442 up position.

The operator can also set the needle down position to be twenty degrees before bottom dead center. The operator accomplishes this by rotating the inside tape collar at the handwheel. The needle down position is where the needle 442 will be when the ruffler blade 440 starts its OUT stroke. This needle down position is not related to the sewing needle's 442 down position.

Further, the operator can set the presser foot height. When the presser foot is up, there should be a quarter inch between the bottom of the foot and the throat plate. The presser foot height can also be set according to predetermined configurations.

In setting the position of the two shock absorbers on the ruffler drive assembly, the operator ensures that the rear shock extends one inch of thread out from the bracket toward the front of the sewing machine 320. The front shock generally extends one-half inch of thread out from its bracket toward the rear of the sewing machine 320.

To properly set the ruffler assembly, the operator must first set the ruffler blade 440 (pleating blade 440) position left to right. The slot in the ruffler blad 440 aligns with the sewing needle 442. The operator loosens the clamp screw and adjusts the left ruffler arm. Next, the operator sets the ruffler blade 440 IN position (second position) so that the ruffler blade 440 extends ⅛" past the needle 442 when the needle is at bottom dead center (adjustments are made with the air turned off). The operator then loosens the clamp screw on the right drive arm and ensures that the right drive arm is pushed all the way in, thereby compressing the rear ruffler shock absorber. The operator then rotates the ruffler blade holder as needed. Afterwards, the operator sets the ruffler blade 440 OUT position (first position), so that the ruffler blade 440 is ¾" in front of the needle. The operator makes this adjustment by turning the large plastic adjusting knob in front of the ruffler drive bracket. After turning the air back on, the operator sets the ruffling foot lift cylinder position so that the foot is lifted ⅛" when the ruffler blade 440 is in. Next, the operator slides the foot lift arm up or down the cylinder rod. The operator accomplishes this by disconnecting the cap from the front airline on the ruffler cylinder and turning on and off the ruffler cylinder. Finally, the operator sets the blade drive arm so that when the ruffler blade 440 is down and touching the stripper blade there is still ⅛" of cylinder rod showing on the blade lift cylinder.

To set the folder assembly, the operator begins by adjusting the shock absorber, stop screw, and rod end on the folder sub-assembly so that the folder assembly is level with the cloth plate in the down position. Next, the operator adjusts the up position shock absorber so that the shock bottoms out when the cylinder bottoms out. Then the operator adjusts the stripper blade mount so that the tip of the blade is ⅛" above the throat plate at the presser foot and the clearance under the folder at the guide wheel is ¼". Next, the operator adjusts the rod end on the in/out cylinder so that the end of the stripper blade is ¼" in front of the needle 442 at needle bottom dead center. Subsequently, the operator sets the cylinder limit switches for proper operation at the ends of stroke. Further, the operator adjusts the folder left to right so that the right edge is 2-¼" to the right of the needle 442. After adjusting the folder 316, the operator sets the folders 316 for a 2-½" folded capacity. Next, the operator adjusts the guide rods to be perpendicular to and centered on the center-line of the top folder 316. Further, the operator adjusts the tension cylinder so that the tension plate opens ¼" when the tension pressure is off (the operator ensures that the cylinder does not bottom out when the tension is on, because the lifting of the puller forces the tension plate open). Finally, the operator adjusts the height of the gusset end detector to be 1/16" above the cloth plate when it is in its down position and adjusts the photocell for proper sensitivity.

To set the edge guide assembly, the operator starts by adjusting the edge guide so that the wheel is centered on the cutout in the cloth plate and in contact with the bottom of the folder 316 when it is in its up position. The operator checks for proper belt tension when the wheel is up. Next, the operator ensures that the lift cylinder does not bottom out when the wheel is in the up position against the bottom of the folder 316. The operator then adjusts the flow controls for smooth, quiet operation. The operator adjusts the edge guide eye to be looking up through the cutout in the cloth plate and at the same place left to right as the right edge of the folder 316. The operator ensures that there is reflective tape on the bottom of the folder 316 for the eye to see. Additionally, the operator performs another ¼" of adjustments left and right in the adjusting screw from this position.

To properly set the rotary assembly, the operator begins by adjusting the rotator so that the center of rotation is located ¾" to the left of the needle 442 and even with the needle 442 at bottom dead center. The rotator shaft must be perpendicular to the cloth plate. Accordingly, the operator adjusts the pillow block bearings as necessary. Further, the rotate arm should be set for 2-½" clearance above the cloth plate. Next, the operator sets the limit sensors and shock absorbers for 90 degrees of rotation with the rotate arm parallel to the edge of the air table 310 in its rear position (the operator unplugs the stepper motor when rotating the arm by hand to prevent damage to the motor drive unit). The operator then sets the panel clamps to just barely touch the cloth plate when they are in their down position. The small hole in the tip of the offset finger of the inside clamp foot should align with the center of rotation of the rotator shaft (¾" to the left of the needle 442). Accordingly, the operator rotates the arm 90 degrees and checks in both positions. The finger clamp pressure plate should be set flush with the bottom of the other clamps. Therefore, the operator sets the rotary actuator for 90 degrees of rotation. The Sew Head Jam Detector Eye should be looking at reflective tape placed right behind the puller and between the conveyor and the edge guide plate. The Trailing Edge Eye should be looking at a piece of reflective tape located at the left side of the guide wheel cutout hole in the cloth plate and 4-½" in front of the needle 442 location. The operator then adjusts the blower tube flow control so the panel 106 stays flat on the cloth plate while rotating. Finally, the operator adjusts the eye on top of the ruffler cover to be looking at a 2" square piece of reflective tape located even with the needle 442 and 30" from the edge of the air table 310 nearest the sewing machine 320.

To adequately set the puller assembly, the operator sets the puller down position as low as practical without actually touching the cloth plate. The operator ensures that the rollers are centered on the needle 442.

To set up the knife assembly, the operator begins by adjusting the front to back position of the pivot arm on the shaft so that the knife 610 swings down to the cloth plate without hitting anything. The knife 610 should be level at the down position. The tip of the lower knife blade should clear the stripper blade by 1/16" as it swings down and extends ½" to the right of the right edge guide of the folder 316 (the folder 316 must be all the way out). Accordingly, the operator sets the pivot arm limit sensors for top and bottom of stroke. Next, the operator adjusts the shock absorbers so they do not completely bottom out. Finally, the operator sets the safety eye (Knife Obstacle Sensor) position so it will not activate as the knife 610 swings through its entire stroke.

To properly adjust the rear conveyor assembly, the operator sets the conveyor 412 so its is level, parallel to the edge of the air table 310, and in line with the right puller roller. Next, the operator sets the height stop to hold the conveyor 1/32" above the cloth plate and sets the spring adjustments to make the conveyor 412 press down with about 1-2 lbs of weight. The operator then sets the lift cylinder to press the conveyor arm down far enough to activate the UP sensor.

To adequately set the accumulator assembly, the operator begins by setting the down sensor to activate at the bottom of the stroke. Next, the operator adjusts the set collars on the stationary rollers tight against the rollers to provide a little friction to the rollers to help prevent the accumulated loops from unrolling and falling to the bottom of the accumulator 620. The operator then sets the Material Out Eye to see reflective tape wrapped around the center of the nearest stationary roller.

The operator can also perform routine maintenance to the gusset sewing system 300 on a daily, weekly, and monthly occurrence. Daily routines include, but are not limited to, cleaning the gusset sewing system 300 at the end of every shift; cleaning lint and other debris from the looper area on the sewing head; removing any threads wrapped round moving parts of the puller conveyor 412, and accumulator rollers 622; wiping all photo eye lenses with a clean, nonabrasive, dry cloth; using a blow-off hose to get rid of excess lint, thread and other clippings; and properly maintaining the sewing head by following a predetermined set of guidelines. Weekly routines include, but are not limited to, checking all belts for tightness and condition, adjusting or replacing the blets as necessary; checking and cleaning the screens on the blower box; checking the blower v-belt tension and pulleys; and applying a drop of machine oil on all moving ruffler parts. Monthly routines include, but are not limited to, re-lubricating the gusset knife 610 moveable blade and rod end with Teflon® grease, as needed; and re-lubricating the puller and conveyor needle bearings with Telfon® grease, as needed.

The invention thus provides a novel gusset construction, and an automated method and apparatus for rapid construction and attachment of the gusset to a supporting panel or adjoining layer of material. As applied to pillow-top mattress production, the invention greatly facilitates the previously tedious and laborious task of gusset subassembly and attachment to the mattress panel. Panels can be pre-manufacture with the ruffled gusset in a fraction of the time of prior art methods, ready for assembly over the mattress innerspring, followed by attachment of the pillow-top.

The above described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. A method of attaching a gusset to a panel, comprising the steps of:

attaching a gusset to a panel as the gusset and panel are moved along a first substantially linear path as a sewing machine operable for applying stitches to attach the gusset to the panel;

detecting a corner of the panel;

turning the panel in response to the corner of the panel being detected, so that the gusset follows a curved path adjacent the corner of the panel; and providing an independently operable pleat generator to form at least one pleat at a desired location about the panel, said pleat generator operable in timed relation with the operation of the sewing machine; and providing a system controller to control attachment of the gusset and panel, wherein said system controller controls attachment of the gusset to the panel by the pleat generator independently of the operation of the sewing machine and a number of stitches applied thereby, the pleat generator operable at varying rates to enable high speed attachment of the gusset to the panel during part of a sewing operation and attachment of the gusset to the panel at a different rate for pleat generation.

2. The method of claim 1, and further comprising detecting movement of a needle of the sewing machine toward a raised position, engaging the gusset with a pleat formation blade as the needle is in a raised position and forming the pleat in the gusset as needed, and moving the pleat formation blade away from engagement with the gusset as the needle is moved into engagement with the pleat.

3. The method of claim 1, wherein attaching a gusset to a panel comprises sewing at a first desired rate of sewing, and varying the rate of sewing as the panel is turned.

4. The method of claim 3, further comprising the step of reducing the rate of sewing of the gusset to the panel as at least one pleat is formed in the gusset.

5. The method of claim 1, further comprising the step of accumulating a predetermined length of gusset material sufficient to form a gusseted panel of a desired size.

6. An apparatus for sewing a gusset and a flange to a panel, comprising:

a first sewing machine, that receives gusset material from a folding device and flange material, that is operable to sew the gusset material to the flange material, thereby forming a gusset-flange; and a second sewing machine that receives the gusset-flange from the first sewing machine and that sews the gusset-flange to the panel at a first speed and a second speed; and a pleat generator that is operable independently from the first or second sewing machine and in a substantially vibration free operation when the second sewing machine is operating at its second speed for forming a desired number of pleats in the gusset-flange in timed relation to a sewing operation of the second sewing machine sewing about the corner portion of the panel.

7. The apparatus of claim 6, wherein the pleat generator further comprises:

a. a pleat formation blade moveable between a first, non-engaging position and a second position engaging the gusset so that each pleat is formed in the gusset as the gusset is sewn to the panel;

b. an actuator for selectively moving the pleat formation blade from its first position to its second position;

c. a sewing machine state sensor that generates a signal indicative of a position of a sewing needle of the second sewing machine; and the apparatus further comprising a system controller that causes the actuator to move the pleat formation blade to its second position when the sewing machine state sensor indicates that the sewing needle is moving toward a raised position.

8. The apparatus of claim 6, further comprising a material conveyor adjacent the second sewing machine that engages the gusset on the panel and advances the gusset and panel along a sewing path as the gusset is sewn to the panel.

9. The apparatus of claim 6, further comprising a sewing table having a table surface upon which the panel is received and supported, the table surface having a plurality of holes defined therein through which an air flow is passed for assisting movement of the panel along the table surface.

10. The apparatus of claim 6, further comprising a system controller that controls the sewing of the gusset to the panel, wherein the system controller causes the second sewing machine to operate at a first rate for sewing the gusset to the panel when a pleat generator is not operating, and causes the second sewing machine to operate at a second rate when the pleat generator is engaged to form a pleat in the gusset.

11. The apparatus of claim 6, further comprising:

a. an accumulator that draws the gusset material from a source along a feed path so as to accumulate a predetermined length of gusset material sufficient to form a completed gusset panel upon sewing to the panel; and b. a detector mounted along the feed path in a position to detect the accumulation of gusset material and which generates a signal indicating that there is insufficient gusset material in the accumulator.

12. The apparatus of claim 11, wherein the accumulator comprises:

a. a first plurality of rollers mounted in spaced series and about which the gusset material is passed;

b. a second plurality of rollers about which the gusset material is passed and movable between a rest position adjacent the first plurality of rollers and a second position spaced from the first plurality of rollers; and c. a drive mechanism for moving the second plurality of rollers from their first position toward their second position spaced from the first plurality of rollers, so as to draw the gusset material from the source.

13. The apparatus of claim 6, wherein the pleat generator is controlled by a programmable controller.

14. A system for attaching a gusset to a panel, the system comprising:

a sewing machine operable for attaching a gusset to a panel along a first substantially linear path; an edge detector for detecting a corner of the panel;

a pleat generator operable independently of the operation of the sewing machine, including a pleat formation blade moveable between a first, non-engaging position and a second position engaging the gusset so that a pleat is formed in the gusset as the gusset is sewn to the panel and an actuator for selectively moving the pleat formation blade between the first and second position to form a selected number of pleats in the gusset;

a system controller adapted to adjust the sewing machine from a first sewing speed to a second sewing speed when the edge detector detects the corner of the panel, and adapted to control operation of the actuator of the pleat generator to move the pleat formation blade between the first and second position independently of the adjustment of the sewing machine and in timed relation with the sewing of the gusset to the panel about the corner thereof.

15. The system of claim 14, wherein the system controller is further adapted to adjust the sewing machine from the second sewing speed to the first sewing speed after the gusset is attached to the corner of the panel.

16. The system of claim 15, a turning mechanism comprising a clamp arm adapted to engage and turn the panel.

17. The system of claim 15, further comprising a material conveyor that engages the gusset on the panel and advances the gusset and panel together as the gusset is attached to the panel.

18. The system of claim 17 wherein the material conveyor comprises a rotationally driven belt that engages the gusset material in position upon the panel.

19. The system of claim 14, further comprising a turning mechanism for engaging and turning the panel upon detection by the edge detector of the approach of the corner of the panel.

20. The system of claim 19, wherein the sewing machine is adjacent the upper surface of a sewing table, positioned along a sewing path for the panel, for attaching the gusset to the panel.

21. The system of claim 19, wherein a sewing table further includes at least one directional air jet for applying a directional air flow to the panel.

22. The system of claim 19, further comprising an air flow controller that controls airflow through a plurality of ports.

23. The system of claim 22, wherein the air flow controller is programmable so as to cause an increase in air flow as the panel becomes heavier as gusset material is being attached thereto.

24. The system of claim 22, wherein the air flow controller is programmable so as to increase air flow for more porous panel materials.

25. The system of claim 22, wherein the air flow controller is programmable so as to increase air flow for heavier panel materials.

26. The system of claim 14, wherein the ruffler controller is further adapted to receive as an input a number of pleats to form in the gusset.

27. The system of claim 14, further comprising a gusset tensioning device that is capable of controlling tension on the gusset as the gusset is being attached to the panel so that the tension on the gusset is within a desired range for a characteristic of the gusset.

28. The system of claim 14, wherein the edge detector comprises:

a piece of reflective material disposed at a predetermined location under the panel; and an optical sensor that senses when the piece of reflective material is uncovered.

29. The system of claim 14, further comprising a movable knife that is capable of cutting the gusset material after the gusset has been attached to the panel.

30. The system of claim 14, wherein the pleat generator is controlled by a programmable controller.

31. The system of claim 14, further comprising a sewing table having a plurality of ports formed in an upper surface thereof for providing an air flow to the panel moving over the upper surface.

32. The system of claim 16, further comprising an air jet air flow controller that turns on a plurality of directional air jets when assistance is needed to move the panel and that turns off the directional air jets when no assistance is needed.

33. A method for attaching a gusset to a panel, the method comprising:

attaching a gusset to a panel along a first substantially linear path at a first attachment speed;

detecting a corner of the panel;

adjusting the attachment of the gusset to the panel from the first attachment speed to a second attachment speed, when the corner of the panel is detected; and creating at least one pleat in the gusset in a region that is adjacent to the corner of the panel, wherein the creation of the at least one pleat is accomplished independently of the attachment of the gusset to the panel at either the first attachment speed or the second attachment speed and wherein the attachment of the gusset to the panel occurs at varying rates such that attachment can occur at the first speed and generation of the pleats can occur at the second attachment speed.

34. The method of claim 33, further comprising the step of attaching the gusset to the panel along a second substantially linear path, angularly divergent from the first substantially linear path, after the gusset has been attached around the corner of the panel.

35. The method of claim 34, wherein the attachment of the gusset to the panel along the second substantially linear path is at the first attachment speed.

36. The method of claim 33, wherein the creation of the at least one pleat in the gusset is independent from the attaching of the gusset of the panel.

37. The method of claim 33, further comprising the step of selectively determining a number of pleats to form in the gusset, prior to creating the at least one pleat in the gusset in the region adjacent the corner of the panel.

38. The method of claim 33, further comprising the step of turning the panel upon detection of the corner of the panel.

39. The method of claim 33, further comprising the step of providing an air flow to the panel in order to assist in moving the panel during attachment of the gusset to the panel.

40. The method of claim 39, wherein an increased air flow is provided as the panel becomes heavier as the gusset is being attached thereto.

41. The method of claim 33, further comprising the step of advancing the gusset and panel together as the gusset is attached to the panel.

42. The method of claim 33, further comprising the step of controlling the tension of the gusset as the gusset is attached to the panel so that the tension on the gusset is within a desired range for the gusset.

43. The method of claim 33, further comprising the step of cutting the gusset after the gusset has been attached to the panel.

44. The method of claim 33, wherein the pleat generator is controlled by a programmable controller.

45. A system for attaching an intermediate material to a panel, the system comprising:

a sewing machine for attaching an intermediate material to a panel along a first substantially linear path;

an edge detector for detecting a corner of the panel;

a pleat generator that is operable independently from the sewing machine and includes a pleat formation blade moveable between a first non-engaging position and a second position engaging the intermediate material so that a pleat is formed in the intermediate material as the intermediate material is sewn to the panel;

an actuator for selectively moving the pleat formation blade between the first and second position;

a system controller adapted to adjust the sewing machine from a first sewing speed to a second sewing speed when the edge detector detects the corner of the panel, and adapted to control the pleat generator so as to activate the actuator to move the pleat formation blade between the first and second position in timed relation with the sewing of the intermediate material to the panel, wherein the system controller is adapted to receive as an input a number of pleats to form in the intermediate material and the pleat generator operates independently of the operation of the sewing machine.

46. The system of claim 45, wherein the system controller is further adapted to adjust the sewing machine from the second sewing speed to the first sewing speed after the intermediate material is attached to the corner of the panel.

47. The system of claim 45, wherein the number of pleats formed in the intermediate material are evenly spaced.

48. A method for attaching an intermediate material to a panel, the method comprising:

attaching an intermediate material to a panel along a first substantially linear path;

detecting a corner of the panel;

selectively determining a number of pleats to form in the intermediate material;

adjusting the attachment of the intermediate material to the panel from a first attachment speed to a second attachment speed, when the corner of the panel is detected;

creating the selectively determined number of pleats in the intermediate material in timed relation with the attachment of the intermediate material to the panel, wherein the creation of the selectively determined number of pleats is independent from the attachment of the intermediate material to the panel at either the first attachment speed or the second attachment speed.

49. The method of claim 48, wherein the selectively determined number of pleats are evenly spaced.

50. The method of claim 48, further comprising the step of attaching the intermediate material to the panel along a second substantially linear path, angularly divergent from the first substantially linear path, after the intermediate material has been attached around the corner of the panel.

51. The method of claim 50, wherein the attachment of the intermediate material to the panel along the second substantially linear path is at the first attachment speed.

52. A system for attaching a gusset to a panel, comprising:

a sewing machine positioned along a sewing path for a panel to attach the gusset and the panel;

a pleat generator having a pleat formation blade for forming at least one pleat in the gusset at a desired location about the panel, said pleat generator being operable independently from attachment of the gusset to the panel by said sewing machine and wherein said pleat formation blade is moveable in timed relation with said sewing machine for forming the at least one pleat in the gusset as the gusset is sewn to the panel; and a system controller to control at least one of the sewing machine and the pleat generator, the system controller including programming to control attachment of the gusset and the panel at varying rates for attaching the gusset to the panel at a first speed and enabling generation of pleats in the gusset during attachment at speed greater than the first speed.

53. The system of claim 52, further comprising a sewing machine table having an upper surface supporting the panel as the gusset is attached thereto and including a series of ports formed in the upper surface thereof for supplying an air flow to the panel supported on the sewing table, the air flow being variable by the system controller to accommodate variations in the size, weight or material of the panel being sewn.

54. The system of claim 52, further comprising a sewing machine adjacent the upper surface of the sewing table, positioned along a sewing path for the panel, for attaching the gusset to the panel.

55. An apparatus for sewing a gusset and a flange to a panel, comprising:

a first sewing machine, that receives gusset material from a folding device and flange material, that sews the gusset material to the flange material, thereby forming a gusset-flange;

a second sewing machine that receives the gusset-flange from the first sewing machine and that sews the gusset-flange to a panel;

a pleat generator including a pleat formation blade moveable between a first, non-engaging position and a second position engaging the gusset so that a pleat is formed in the gusset as the gusset is sewn to the panel;

an actuator for selectively moving the pleat formation blade from its first position to its second position as needed for forming a desired number of pleats in the gusset-flange;

a sewing machine state sensor that generates a signal indicative of a position of a sewing needle of the second sewing machine; and a system controller that operates said pleat generator independently of the sewing of the gusset flange to the panel so as to cause the actuator to move the pleat formation blade to its second position when the sewing machine state sensor indicates that the sewing needle is moving toward a raised position.

56. An apparatus for sewing a gusset and a flange to a panel, comprising:

a first sewing machine, that receives gusset material from a folding device and flange material, that sews the gusset material to the flange material, thereby forming a gusset-flange;

a second sewing machine that receives the gusset-flange from the first sewing machine and that sews the gusset-flange to a panel;

a pleat generator for forming pleats in the gusset-flange as it is sewn about a corner of the panel, said pleat generator being operable independently from operation of said first and second sewing machines; and a system controller that controls the sewing of the gusset to the panel, wherein the system controller causes the second sewing machine to operate at a first rate for sewing the gusset to the panel when a pleat generator is not operating, and causes the second sewing machine to operate at a second rate when the pleat generator is engaged to form a pleat in the gusset.

* * * * *